US005901680A

United States Patent [19]

Ozeki

[11] Patent Number: 5,901,680

[45] Date of Patent: May 11, 1999

[54] CRANK CHAMBER STRUCTURE FOR AN ENGINE

[75] Inventor: Hisashi Ozeki, Shizuoka-ken, Japan

[73] Assignee: Suzuki Motor Corporation, Shizuoka, Japan

[21] Appl. No.: 09/008,804

[22] Filed: Jan. 16, 1998

[30] Foreign Application Priority Data

Jan. 17, 1997 [JP] Japan ..... 9-019816

[51] Int. Cl.[6] ..... F02F 7/00

[52] U.S. Cl. ..... 123/195 R; 123/195 H

[58] Field of Search ..... 123/195 R, 195 H

[56] References Cited

U.S. PATENT DOCUMENTS

| | | | |
|---|---|---|---|
| 4,467,754 | 8/1984 | Hayashi et al. | 123/195 R |
| 4,773,366 | 9/1988 | Seidl et al. | 123/196 R |
| 5,024,189 | 6/1991 | Ushio et al. | 123/195 R |

FOREIGN PATENT DOCUMENTS

| | | |
|---|---|---|
| 1-113116 | 7/1989 | Japan . |
| 2-103153 | 8/1990 | Japan . |
| 3-122210 | 12/1991 | Japan . |
| 4-276163 | 10/1992 | Japan . |
| 6-29537 | 4/1994 | Japan . |

*Primary Examiner*—Noah Kamen

*Attorney, Agent, or Firm*—Flynn, Thiel, Boutell & Tanis, P.C.

[57] ABSTRACT

A crank chamber structure for an engine which is designed to reduce vibratory noise, to achieve a reduction in weight and cost, and to improve lubricating performance. The crank chamber structure is positioned between a block-side skirt section and a case-side skirt section respectively provided in a cylinder block and a lower case. The skirt sections are curved outwardly to permit the crank chamber to enclose peripheral loci of connecting rods, and further to permit the crank chamber to be formed by a curvilinear surface whose radius is smaller at successively higher positions above the crankshaft axis, thereby providing a substantially egg-like cross-sectional shape. An opening is provided in the lower case by the case-side skirt section being collapsed to taper toward an oil pan-mating surface of the lower case so as to communicate with the oil pan.

6 Claims, 18 Drawing Sheets

CRANK CHAMBER STRUCTURE FOR AN ENGINE

FIELD OF THE INVENTION

This invention relates to a crank chamber structure for an internal combustion engine and, more particularly, to a crank chamber structure for an engine which is designed to reduce vibratory noise from the engine, to achieve a reduction in weight and cost thereof, and to improve the lubricating performance of the engine.

BACKGROUND OF THE INVENTION

FIG. 20 illustrates one example of a conventional engine as disposed in a vehicle. In this engine 202, a cylinder head 206 is disposed on a cylinder block 204. A head cover 208 is positioned on the cylinder head 206. A lower case 212 is positioned below the cylinder block 204 and cooperates therewith for rotatably supporting a crankshaft 210 which extends lengthwise of the engine along its rotational axis A. An oil pan 214 is provided below the lower case 212. A baffle plate 216 is located in the oil pan 214. A crank chamber 218 is defined between the cylinder block 204 and the lower case 212.

One end of a connecting rod 220 of the engine 202 is connected to an eccentric crank of the crankshaft 210, and the other end thereof is linked to a piston 222 which is reciprocally supported in a cylinder 224. A plurality of crank-connecting rod-piston-cylinder arrangements are disposed in sidewardly spaced relation along the length of the engine in a conventional manner.

As illustrated in FIGS. 21 and 22, the cylinder block 204 is provided with: sleevelike cylinder-retaining sections 226 for press-fitting the cylinders 224 therein; block-side journal sections or walls 228 located below the cylinder-retaining sections 226 for rotatably supporting the crankshaft 210; and block-side skirt sections or walls 230 connected to the block-side journal sections 228. The skirt section 230 has a lower case-mating part 232 provided at a lower end thereof which defines a lower case-mating surface 234. Reference numeral 236 denotes a block-side blow-by gas passage.

A valve-driving mechanism 240 (FIG. 20) in the cylinder head 206 is disposed in a valve drive chamber 238. In addition, the cylinder head 206 has a head-side blow-by gas passage 242 provided therein for communicating the block-side blow-by gas passage 236 and the valve drive chamber 238 with one another. A breather chamber 244 is provided in the head cover 208 which communicates with the head-side blow-by gas passage 242. The breather chamber 244 communicates with one of an intake system or, e.g, a throttle body 246.

Referring now to FIGS. 23–27, the lower case 212 is provided with: case-side journal sections or walls 248 for rotatably supporting the crankshaft 210 in conjunction with the block-side journal sections 228; and case-side skirt sections 252 connected to the case-side journal sections 248 by means of ribs 250. The case-side skirt section 252 has a block-mating part 254 provided on the top thereof which defines thereon a top block-mating surface 256. In addition, the case-side skirt section 252 has an oil pan-mating section 258 provided on the bottom thereof which defines thereon an oil pan-mating surface 260. Reference numeral 262 denotes a case-side blow-by gas passage; 264 a case-side oil drop passage; 266 an oil pump; and 268 an oil strainer.

Turning now to FIGS. 28 and 29, the oil pan 214 is illustrated and includes a bottom portion 270 and a peripheral wall or skirt portion 272. The peripheral wall portion 272 has a lower case-mating flange 274 provided on the top thereof which defines a lower case-mating surface 276. The baffle plate 216 is provided in the oil pan 214 supported on the peripheral wall portion 272, and is offset downwardly from the lower case-mating surface 276 toward the bottom portion 270. The baffle plate 216 has a strainer-adapted hole 278 formed therethrough for inserting the oil strainer 268 therethrough.

As illustrated in FIG. 20, in the engine 202, the crank chamber 218 is oriented in a plane perpendicular to the crankshaft axis is formed into a substantially trapezoidal shape by means of the block-side skirt sections 230 and the case-side skirt sections 252, both of which skirt sections are substantially planar-shaped. The crankshaft 210 and the lower ends of the connecting rods 220 are rotated in the crank chamber 218.

Examples of such a crank chamber structure are disclosed in published Japanese Patent Application Laid-Open No. 4-276163, Japanese Utility Model Application Laid-Open No. 2-103153, and Japanese Utility Model Application Laid-Open No. 3-122210.

According to above-mentioned Application No. 4-276163, a ladder frame structure is provided in which both ends of a plurality of shaft-supporting caps are successively arranged on side walls for supporting a crankshaft from below. The side walls mate with skirt portions of a cylinder block. The ladder frame structure is characterized by a linear-shaped connecting beam which is oriented in the axial direction of the crankshaft for connecting lower portions of the aforesaid caps together. The connecting beam consists of a single member.

According to above-mentioned Application No. 2-103153, a lower case structure is provided for covering lower portions of independent main bearing caps which cooperate with crank journals in a cylinder block. The lower case structure is characterized by a lower case which is fixed to the cylinder block by fixing bolts. The lower case includes the following: a mounting flange portion which is mountable on the cylinder block by being brought into contacting engagement with a lower edge of the cylinder block; an underside-supporting portion which is forced into impinging engagement with the underside of the main bearing cap; and a stomach portion positioned on the peripheries of rotational loci of a crank counterweight and a connecting rod. The stomach portion connects the mounting flange portion and the underside-supporting portion with one another. The stomach portion has a semi-circular shape in cross-section. Further, one of the aforesaid fixing bolts penetrates both the underside-supporting portion and the main bearing cap. The other of the fixing bolts is driven through the aforesaid mounting flange portion.

According to aforesaid Application No. 3-122210, a lower block is provided in which skirt portions and bearing cap portions are integrally combined together. The lower block is characterized by arcuate ribs which extend from the skirt portions for connecting between the bearing cap portions so as to be spaced from rotational loci of the crankshaft webs and the connecting rods. The lower block also has a return opening for return oil provided at a position of the rib where a fresh air-introducing passage for ventilating blow-by gas is absent, between the bearing cap portions around the lower run of crankshaft rotation.

Other examples of crank chamber structures are disclosed in published Japanese Patent Application Laid-Open No. 6-29537 and Japanese Utility Model Application Laid-Open No. 1-113116.

According to above-mentioned Application No. 6-29537, an engine block having cylinders arranged in a V-shaped configuration is provided with upper and lower sections of a crank case. The lower section is provided with outer case walls which are opposed and parallel to each other. In addition, both ends of semi-cylindrical-shaped inner case walls are connected to the top of the outer case walls. The inner case walls extend along outlines of the connecting rods. As a result, a crank chamber is partitioned from an oil reservoir. Further, the inner case walls are provided with a plurality of passages which communicate with the oil reservoir.

According to aforesaid Application No. 1-113116, a slanted engine is provided in which bearing caps are coupled to a cylinder block, thereby supporting a crankshaft. The engine is characterized in that a curvilinear baffle plate and the bearing caps are integrally formed together between bearing portions of the bearing caps. The baffle plate is separated from an oil surface along rotational loci of the connecting rod and the crank weight. In addition, an oil return hole opens at an upper portion of the baffle plate. Further, a blow-by gas passage is punched at the upper portion of the baffle plate. The passage is positioned toward the oil pan rather than the baffle plate.

Attention is now directed to a construction of the crank chamber 218 of the engine 202 and, as illustrated in FIGS. 23–27, the lower case 212 has large openings 280 positioned between the opposed case-side skirt sections 252. The openings 280 are in communication with the oil pan 216. In addition, the oil pan-mating surfaces 260 are provided at the bottom of the skirt sections 252.

FIG. 30 illustrates another construction of the crank chamber 218, in which the cylinder block 204 is provided with block-side skirt sections 230 which have a substantially semi-cylindrical shape. The skirt sections 230 are directed in the axial direction of the crankshaft 210, and the lower case 212 is provided with case-side skirt sections 252 which have a substantially semi-cylindrical shape. The case-side skirt sections 252 mate with the block-side skirt sections 230, thereby forming a generally cylindrical-shaped crank chamber 218.

However, a problem with the lower case 212 illustrated in FIGS. 23–27 is that the openings 280 are so wide that the oil pan-mating surfaces 260 are enlarged. As a result, the cylinder block rib and the lower case 212 are reduced in rigidity and strength, although serving as a case which surrounds the crankshaft 210 and the connecting rods 220. This causes an inconvenience in that such reduced rigidity and strength is a source of vibratory noise which occurs when the engine is run.

A further problem with the planar-shaped skirt sections 230, 252 shown in FIGS. 21–27 as well as the cylindrical-shaped skirt sections 230, 252 shown in FIG. 30 is that a surface area of the case enclosing the crankshaft 210 and the connecting rods 220 is increased. This causes further inconveniences in that such an increased surface area involves increases in weight and cost, and further, since the planar shape is responsible for reduced rigidity and strength, such an increased surface area is the cause of vibratory noise when the engine 202 is run.

Further, since the planar-shaped skirt sections 230 and 252 illustrated in FIGS. 21–27 form the crank chamber 218 which opens downwardly in a substantially trapezoidal shape, such configuration is liable to disturb rotational wind produced from the crankshaft 210 and the connecting rods 220, both of which are rotated in the crank chamber 218. In addition, the cubic volume of gases in the crank chamber 218 increases. Thus, when the crankshaft 210 and the connecting rods 220 are rotated, the gases are thereby stirred up, which results in air resistance. Therefore, output loss from the engine 202 increases.

Since the crank chamber 218 opens downwardly in a substantially trapezoidal shape, a spray of oil splashed in the crank chamber 218 by respective rotations of the crankshaft 210 and connecting rods 220 is blown into the oil pan 214 through the openings 280 at high speeds. Then, another problem lies in that such oil is caused to impinge on the peripheral wall portion 270 or the baffle plate 216, thereby producing aeration. This brings about yet another inconvenience in that the amount of aeration in the oil, which oil is drawn from the oil strainer 268 and is thereafter conveyed to each section of the engine 202 by means of the oil pump 266, increases, thereby reducing the lubricating performance of the engine 202.

In the crank chamber 218, the spray of oil turns to oil mist. The oil mist is moved into the breather chamber 244 in the head cover 208 after flowing through the case-side blow-by gas passage 262, the block-side blow-by gas passage 236, and the head-side blow-by gas passage 242 in this order. In this case, as illustrated in FIG. 20, if the crank chamber 218 opens downwardly in a substantially trapezoidal shape, and further if a passage inlet 282 of the case-side blow-by gas passage 262 is positioned close to the oil pan 214, then an increased quantity of the oil mist is moved into the breather chamber 244. Then, still another inconvenience is that the breather chamber 244 must be made larger in cubic capacity, thereby increasing the height, weight, and cost of the engine 202.

Turning now to a construction of the crank chamber 218 illustrated in FIG. 30, the lower case 212 has wide openings 280 provided between the case-side skirt sections 252, which openings 280 communicate with an oil pan (not shown). Similarly to the above, this construction also causes inconveniences in that the reduced rigidity and strength as earlier mentioned contribute to vibratory noise when the engine 202 is run. Further, such splashed oil as previously described reduces the lubricating performance of the engine 202, with consequential increases in the height, weight, and cost of the engine 202.

As illustrated in FIGS. 23–27, the case-side journal sections 248 in the lower case 212 are connected at both ends thereof to the respective case-side skirt sections 252 by means of a pair of ribs 250. The journal section 248 is thereby integrally combined at both ends thereof with the block-mating sections 254 and the oil pan-mating sections 258. The former mating section 254 is positioned on the top of the skirt section 252, while the latter mating section 258 is located on the bottom of the skirt section 252. As a result, the case-side journal section 248 is supported at both ends thereof on the skirt sections 252, the block-mating sections 254, and the oil pan-mating sections 258, which sections 252, 254, and 258 are remote from the axis of the crankshaft 210. As a result, support in the axial direction of the crankshaft 210 is insufficient when the engine 202 is run. This causes an inconvenience in that the journal section 248 is deformed in the axial direction of the crankshaft 210, resulting in vibratory noise.

As illustrated in FIGS. 23–27, the lower case 212 is provided with the planar-shaped case-side skirt portions 252 which extend from the block-mating sections 254 to the oil pan-mating sections 258. The lower case 212 also has the wide openings 280 positioned between the skirt sections 252, which openings 280 communicate with the oil pan 214. Referring now to the lower case 212 as shown in FIG. 30, planar-shaped case-side outer skirt sections 284 are positioned in outward directions of the semi-cylindrical case-side skirt sections 252. The outer skirt sections 284 extend from the block-mating sections 254 to the oil pan-mating sections 258. In addition, the wide openings 280, which communicate with the oil pan 214, are provided between the case-side skirt sections 252.

In the lower case 212, the planar skirt section 252 extending between the mating sections 254 and 258 is thereby formed into a longitudinal face. Such longitudinal face is reduced in rigidity in a direction in which the longitudinal face is bent. Consequently, the skirt section 252 experiences greater deformations due to vibration incurred with operation of the engine 202. This causes inconveniences in that such vibrations are conducted to the oil pan 214, resulting in noise emission, or resulting in breakage of the baffle plate 216, depending upon the shape of the baffle plate 216.

In the lower case 212 shown in FIG. 30, the semi-cylindrical case-side skirt sections 252 and the planar case-side outer skirt sections 284 are connected together at the block-mating sections 254. As a result, two wall portions are formed adjacent to the block-mating sections 254. This creates a problem in that such wall portions are useless sections. Further, in the lower case 212 illustrated in FIG. 30, the skirt section 252 has an oil drop hole 286 provided therethrough. This causes an inconvenience in that the skirt section is reduced in rigidity, thereby emitting the vibratory noise.

As shown in FIG. 23, the lower case 212 has case-side mounting boss portions 290 arranged on the block-mating sections 254 for sealing block-adapted outer seal surfaces 288 of the block-mating surfaces 256. However, the seal surfaces 288 are provided so as to deviate from the axis which extends between the centers of the boss portions 290. In addition, the boss portions 290 are provided at respective positions spaced apart from the ribs 250. The ribs 250 support the journal sections 248 on the case-side skirt sections 252, the block-mating sections 254, and the oil pan-mating sections 258. As a result, an inconvenience arises in that the lower case-mating surfaces 234 of the cylinder block 204 and the block-mating surfaces 256 of the lower case 212 cannot be fitted together with sufficient surface pressure, resulting in a reduction in sealing performance, because the block-adapted outer seal surfaces 288 are displaced from the axis extending between the centers of the boss portions 290. A further inconvenience is that, when the engine 202 is run, then the mounting boss portions 290 permit transmission of vibration caused by the crankshaft 210 directly to the oil pan-mating sections 258 and the case-side skirt sections 252 from the case-side journal sections 248, resulting in the vibratory noise, because the boss portions 290 are not directly connected to the above-described ribs 250, but instead are spaced apart therefrom.

As shown in FIG. 25, in the lower case 212, a passage inlet 282 of the case-side blow-by gas passage 262 and a passage outlet 292 of the case-side oil drop passage 264 are positioned adjacent to the journal section 248, and are further oriented in a direction toward the oil pan 214 beneath the passages 282 and 292. As a result, oil falling from the oil drop passage 264 drops directly into the oil pan 214, and then collides therewith. Then, one problem is that oil mist and aeration are liable to occur. Further, blow-by gas containing a large amount of the oil mist near the crankshaft 210 is drawn from the inlet 282 of the oil drop passage 264, and then the oil mist is moved into the breather chamber 244 in large quantities. For this reason, the breather chamber 244 must be made larger in cubic volume. This causes an inconvenience due to an increase in the height, weight, and cost of the engine 202. Another inconvenience lies in that oil containing the aeration is drawn from the oil strainer 268, and then the aeration in the oil fed to each section of the engine 202 by means of the oil pump 266 increases in quantity, thereby reducing the lubricating performance of the engine 202.

Referring to FIG. 26, the lower case 212 has a strainer-mounting boss portion 294 positioned on the oil pan-mating surface 260. As illustrated in FIG. 27, the oil strainer 268 is directly mounted on the boss portion 294. In addition, a bracket-mounting boss portion 296 is provided on the oil pan-mating surface 260, and the oil strainer 268 is indirectly mounted on the bracket-mounting boss portion 296 through a strainer-adapted bracket 298. As a result, the oil strainer 268 experiences a large amount of deformation from the case-side journal section 248 because the oil strainer 268 is mounted on the journal section 248 which is subject to deformation due to vibration from the crankshaft 210 when the engine 202 is run. For this reason, the strength of the oil strainer 268 and the strainer-adapted bracket 298 must be increased, which causes another inconvenience of increased weight and cost.

As illustrated in FIGS. 28 and 29, the oil pan 214 has the baffle plate 216 mounted on the peripheral wall portion 272. The baffle plate 216 is positioned toward the bottom 270 rather than the lower case-mating surface 276. In addition, a strainer-adapted hole 278 opens through the baffle plate 216, through which the oil strainer 268 is inserted. As a result, there is an inconvenience in that the oil pan 214 requires a working process including mounting the baffle plate 216 on the oil pan 214, with a concomitant rise in cost of the oil pan 214. Further, since the strainer-adapted hole 278 which receives the oil strainer 278 is included on the baffle plate 216, then the oil dropping from the aforesaid hole 278 produces aeration near a strainer suction opening 300. This causes a further inconvenience in that the quantity of aeration in the oil increases, thereby reducing the lubricating performance of the engine 202.

Moreover, since the baffle plate 216 is mounted on the peripheral wall portion 272 so as to entirely cover the bottom 270 of the oil pan 214, this causes an inconvenience due to the increased dimension, weight, and cost of the baffle plate 216, and another inconvenience as a source of noise emission. Further, since the baffle plate 216 is mounted on the peripheral wall portion 272 at a position toward the bottom 270 rather than the lower case-mating surface 276, and is further spaced apart from the revolving crankshaft 210 and the connecting rods, then rotational wind from the crankshaft 210 and the connecting rods 220, both of which are rotated in the crank chamber 218, is subject to disturbance. In addition, gases in the crank chamber 218 are increased in cubic volume. Then, when the crankshaft 210 and the connecting rods 220 are rotated, the gases are thereby stirred up, which results in air resistance. This creates another inconvenience of increased output loss from the engine 202.

SUMMARY OF THE INVENTION

In order to overcome or alleviate the above-mentioned inconveniences, the present invention provides a crank chamber structure for an engine, having a cylinder head disposed above a cylinder block of the engine, a head cover disposed on the cylinder head, a lower case positioned below the cylinder block for rotatably supporting a crankshaft, an oil pan provided below the lower case, a baffle plate provided in the oil pan, and a crank chamber positioned between the cylinder block and the lower case. The improvement includes: a block-side skirt section and a case-side skirt section respectively provided on the cylinder block and the lower case, both of the skirt sections being curved outwardly to permit the crank chamber to enclose peripheral loci of connecting rods, and further to permit the crank chamber to be formed by a curvilinear surface whose radius is smaller at successively higher positions, but is greater at successively lower positions, thereby providing a substantially egg-like cross-sectional shape; and an opening communicating with the oil pan, in which the opening is provided in the lower case by the case-side skirt section being collapsed to taper toward an oil pan-mating surface of the lower case.

In a crank chamber structure for an engine pursuant to the present invention, a case-side bearing beam is provided in the lower case for connecting the case-side journal section with the oil pan-mating surface of the case-side skirt section, the journal section rotatably supporting the crankshaft, and wherein the case-side bearing beam is curved such that a portion of the bearing beam connecting with the case-side journal section is inwardly located, while a portion of the bearing beam between the case-side journal sections is outwardly situated.

In a crank chamber structure for an engine pursuant to the present invention, the lower case has a case-side outer skirt section positioned outside the case-side skirt section for connecting a substantially midway portion of the case-side skirt section with the oil pan-mating section.

In a crank chamber structure for an engine pursuant to the present invention, the lower case is provided with a pair of ribs, whose ends are linked to respective portions where the case-side journal sections and the case-side bearing beams are connected together, while the other ends of the pair of ribs extend in an outwardly spreading manner, and are further connected respectively to the block-mating sections and the oil pan-mating sections. Further, a case-side blow-by gas passage and a case-side oil drop passage are provided between the pair of ribs, the case-side blow-by gas passage and the case-side oil drop passage having a passage inlet and a passage outlet respectively provided at the oil pan-mating surface, and respective protrusions being provided in the inlet and outlet, each of the protrusions including a slanted surface which projects outwardly, and the surface also being inclined inwardly from the oil pan-mating surface toward the block-mating surface, whereby the passage inlet and outlet are positioned offset outwardly, and are further made smaller in cross-sectional area than both of the case-side blow-by gas passage and the case-side oil drop passage.

In a crank chamber structure for an engine pursuant to the present invention, the cylinder block is provided with a block-side blow-by gas passage whose one end communicates with the case-side blow-by gas passage of the lower case. The cylinder head is provided with a head-side blow-by gas passage whose one end communicates with the block-side blow-by gas passage, while the other end of the head-side blow-by gas passage communicates with a breather chamber inside the head cover, and wherein the case-side blow-by gas passage, the block-side blow-by gas passage, and the head-side blow-by gas passage are arranged in the lower case, the cylinder block, and the cylinder head, respectively, so as to be in linear communication with each other.

In a crank chamber structure for an engine pursuant to the present invention, a baffle plate is provided on the lower case for covering the opening of the lower case, and further for forming the crank chamber in cooperation with both of the block-side skirt section and the case-side skirt section, the crank chamber having the substantially egg-like cross-sectional shape, the baffle plate being mounted on the case-side bearing beam.

In the crank chamber structure pursuant to the present invention, the block-side skirt sections and the case-side skirt sections are curved outwardly so as to permit the crank chamber to enclose loci of the connecting rods, and further to provide the substantially egg-like cross-sectional shape. Such a cross-sectional shape approximates a spherical surface so that it is possible to provide improved rigidity of the crank chamber as well as a smaller surface area of the crank chamber. In addition, with the aforesaid cross-sectional shape it is possible to provide a smooth flow of rotational wind caused by respective revolutions of the crankshaft and the connecting rods, and further to reduce the cubic volume of gases in the crank chamber.

In the crank chamber structure, the opposed case-side skirt sections converge inwardly so as to taper toward the oil pan-mating surface, whereby the lower case is provided with the openings which communicate with the oil pan. As a result, a spray of oil which is blown from both of the crankshaft and the connecting rods can be drawn directly into the oil pan in reduced amounts, with a consequential reduction in aeration and oil mist, both of which occur in the oil pan.

In the crank chamber structure, case-side bearing beams are provided which are curved outwardly for connection of the case-side journal sections. It is thus possible to provide bearing beams whose rigidity is high enough to reinforce the journal sections with the aid of the skirt sections of the lower case. Such a curved formation of the bearing beams makes it possible to provide the crank chamber structure closest in shape to peripheral loci of the connecting rods. In addition, the case-side bearing beams are curved to stay closer to the case-side journal sections, whereby the supporting rigidity of the journal sections in the axis direction of the crankshaft can be enhanced.

In the crank chamber structure, the case-side outer skirt sections are arranged outwardly from the case-side skirt sections for connecting substantially midway portions of the case-side skirt sections with the oil pan-mating sections. The case-side skirt sections and the case-side outer skirt sections thus allow the lower case to form a substantially inverted "y"-like cross-sectional shape on one side of the lower case, with a similar but mirror image cross-sectional shape being formed on the other side of the lower case, as illustrated in FIG. 1. As a result, the bending rigidity of the lower case in longitudinal and transverse directions thereof can be increased, and the oil pan-mating surfaces can be controlled from being deformed when the engine is run. In addition, the lower case can be made lighter in weight, when compared with a lower case having a "reversed V-shaped cross section".

In the crank chamber structure, the case-side blow-by gas passage and the case-side oil drop passage are positioned between the pair of ribs. The pair of ribs extend in spreading relation to the block-side mating section and the oil pan-mating section from a portion of the lower case where the case-side journal section and the case-side bearing beam are connected together. Further, a passage inlet of the case-side blow-by gas passages and a passage outlet of the case-side oil drop passage are positioned so as to be offset outwardly by means of the respective protrusions, each of which has a slanted surface. Moreover, the aforesaid inlet and outlet are made smaller in cross-sectional area by means of the protrusions than the above case-side gas passages. As a result, the crank chamber structure can be configured in such a manner that the oil mist, which occurs in the crank chamber having the substantially egg-like cross-sectional shape, cannot be moved to the inlet of the case-side blow-by gas passage without flowing below the case-side bearing beams.

In the crank chamber structure, since the respective inlet and outlet of the case-side blow-by gas passage and the case-side oil drop passage positioned between the above-described pair of ribs are offset outwardly, then the inlet and outlet are thereby spaced apart from the axis of the crankshaft, and oil falling into the oil pan from the outlet can be isolated from a suction opening of the oil strainer. In addition, the inlet can be remote from a location adjacent the revolving crankshaft where the oil mist is present in large quantities.

Moreover, in the crank chamber structure, the respective inlet and outlet of the case-side blow-by gas passage and the case-side oil drop passage positioned between the above-described pair of ribs are made smaller in cross-sectional area than the aforesaid case-side passages. Thus, the velocities of gases can be accelerated by means of the inlet having a smaller cross-sectional area, and can thereafter be delayed by means of the case-side blow-by gas passage having a larger cross-sectional area. Similarly to the breather chamber in the head cover, the crank chamber structure is allowed to function as a separator.

In the crank chamber structure, the case-side blow-by gas passage of the lower case, the block-side blow-by gas passage of the cylinder block, and the head-side blow-by gas passage of the cylinder head are arranged so as to be in substantially linear communication with each other. As a result, blow-by gas is smoothly movable into the breather chamber in the head cover without being lodged substantially midway along the above passages.

In the crank chamber structure, the baffle plate is provided for covering the openings of the lower case, and further for forming the crank chamber in cooperation with the block-side skirt sections and the case-side skirt sections. The crank chamber has the substantially egg-like cross-sectional shape. The baffle plate is mounted on the case-side bearing beams. As a result, the baffle plate need not be provided with a strainer-adapted hole which is provided for receiving the oil strainer through the strainer-adapted hole. The baffle plate can be made smaller in dimension, when compared with that on the oil pan. In addition, the baffle plate can be formed so as to have a smooth curvilinear surface shape which continuously extends from the substantially egg-like cross-sectional shape of the crank chamber. As a result, cubic volume inside the crank chamber can be reduced.

DETAILED DESCRIPTION

An embodiment of the present invention will now be described with reference to FIGS. 1–19.

Figure 4:
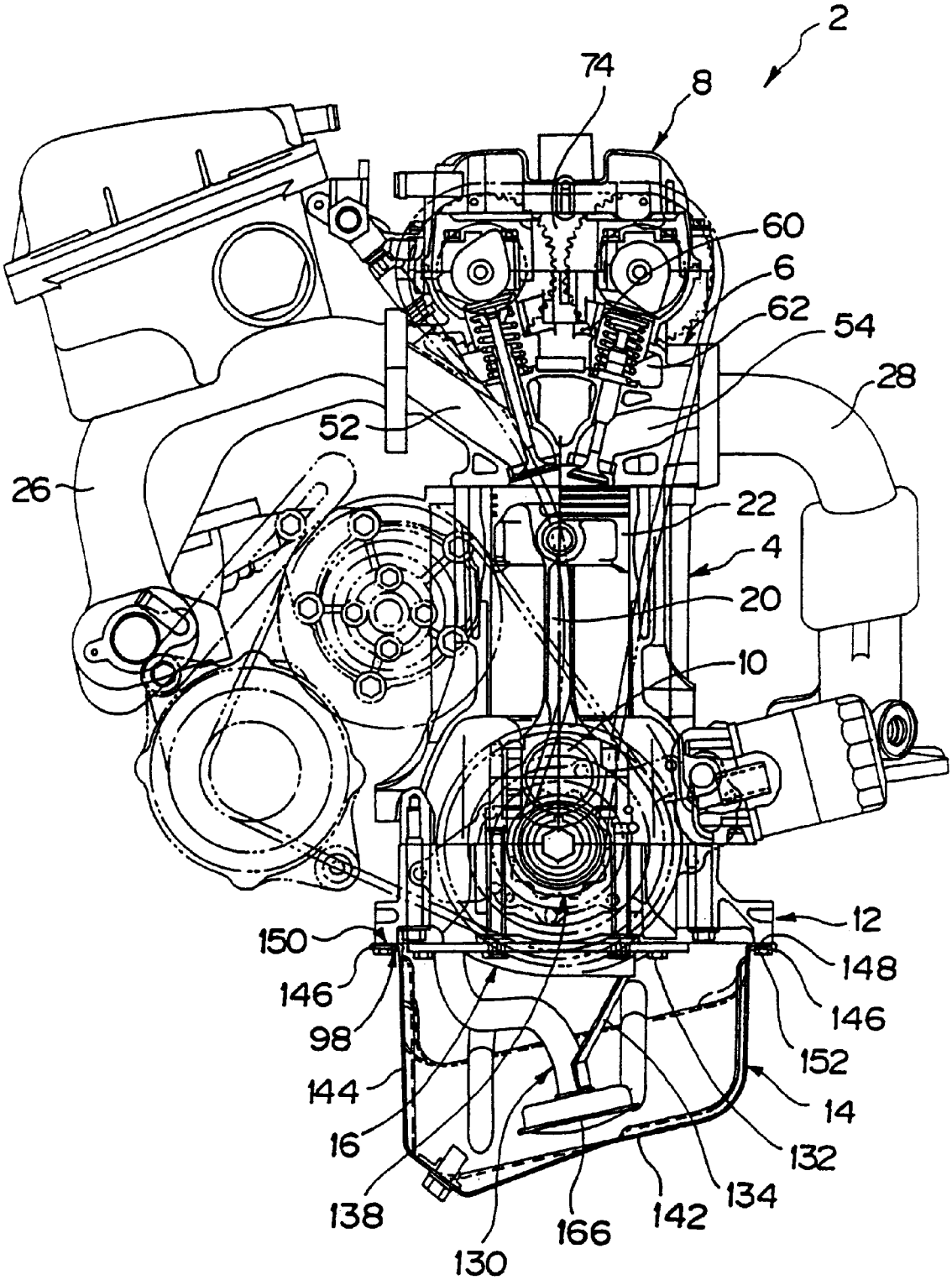
FIG. 4 is a cross-sectional view showing the engine.
Figure 5:
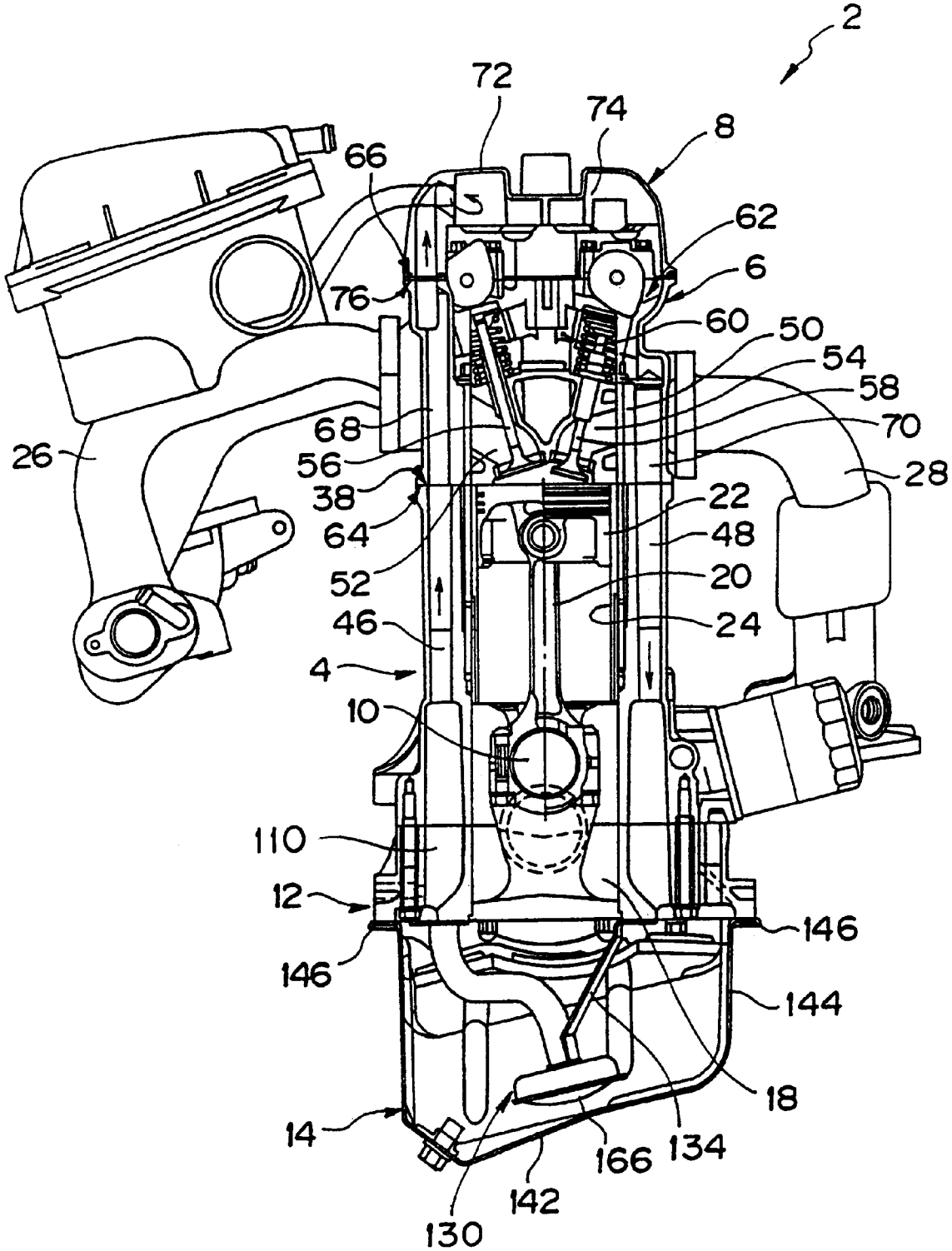
FIG. 5 is a cross-sectional view illustrating a portion of the engine in which blow-by gas passages are provided.
Figure 6:
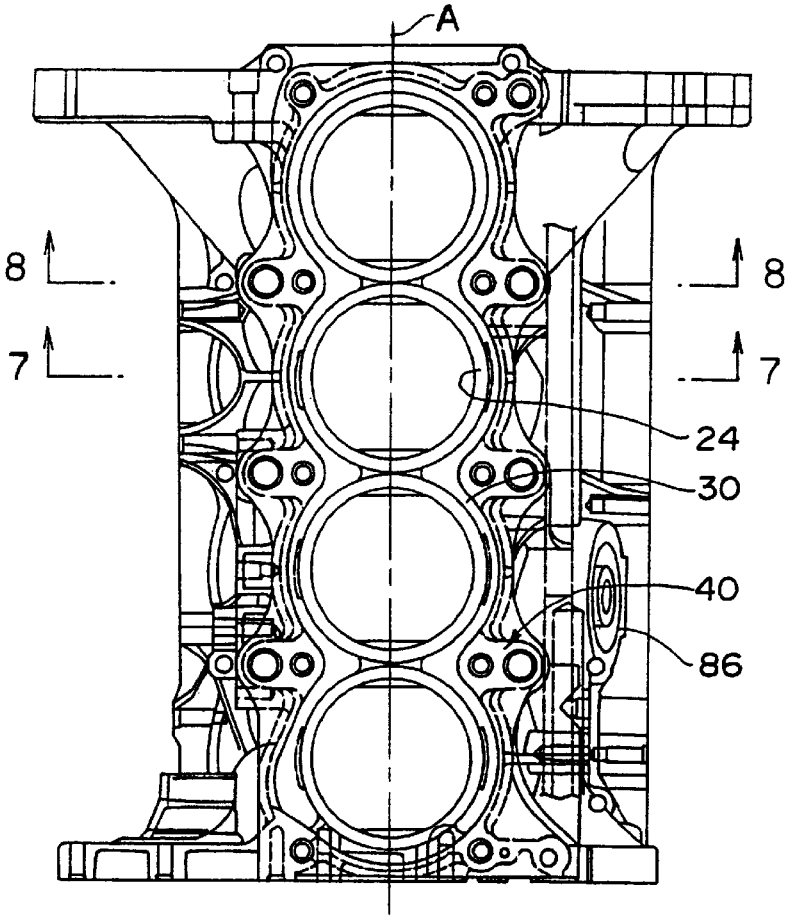
FIG. 6 is a plan view illustrating a cylinder block of the engine having a lower case mounted thereon.
Figure 7:
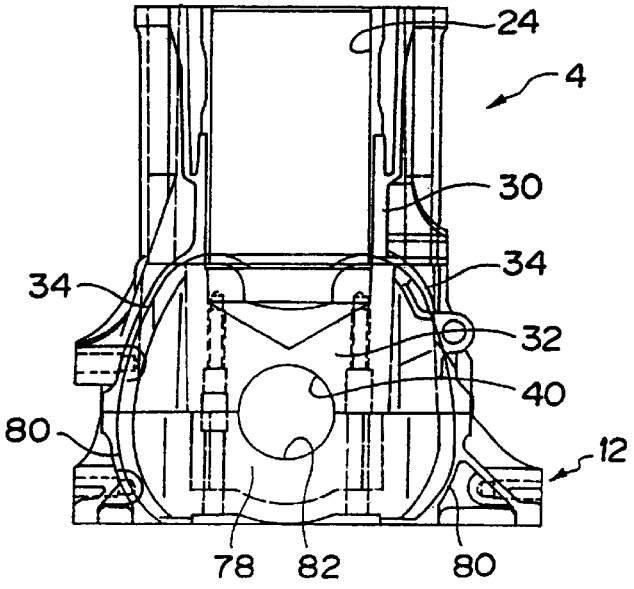
FIG. 7 is a cross-sectional view taken along line 7—7 of FIG. 6 and showing the cylinder block having the lower case mounted thereon.
Figure 8:
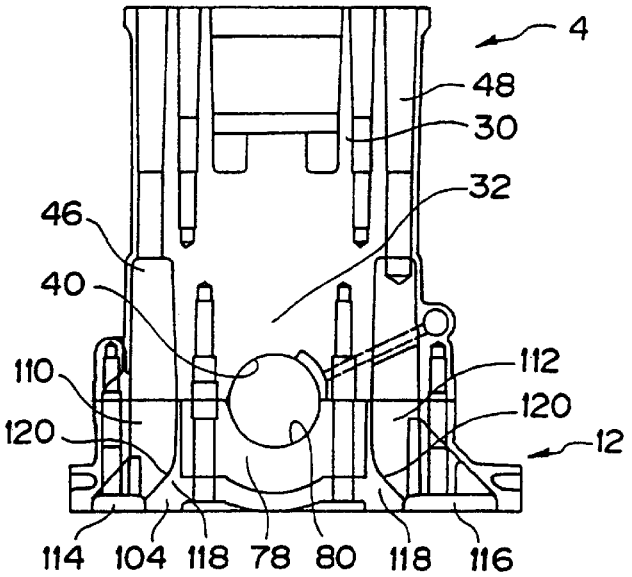
FIG. 8 is a cross-sectional view taken along line 8—8 of FIG. 6 and illustrating the cylinder block having the lower case mounted thereon.
Figure 9:
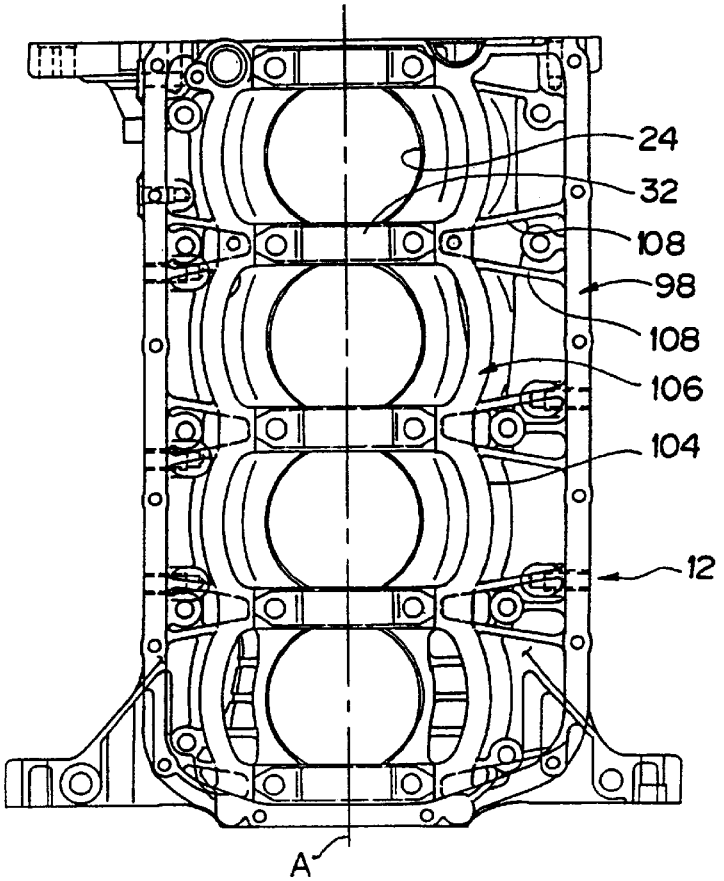
FIG. 9 is a bottom view illustrating the cylinder block having the lower case mounted thereon.

In FIGS. 4 and 5, an engine 2 has a cylinder head 6 disposed on a cylinder block 4, and a head cover 8 positioned on the cylinder head 6. The engine 2 further has the following: a lower case 12 positioned below the cylinder block 4 for rotatably supporting a crankshaft 10 therebetween; an oil pan 14 provided below the lower case 12; a baffle plate 16 located in the oil pan 14; and a crank chamber 18 positioned between the cylinder block 4 and the lower case 12.

In the engine 2, one end of each of a plurality of connecting rods 20 is rotatably connected to one of the eccentric cranks of the crankshaft 10, and a piston 22 is rotatably connected at the other end of each connecting rod 20. The piston 22 is reciprocally slidably positioned in a respective cylinder 24. Reference numerals 26 and 28 denote an intake manifold and an exhaust manifold, respectively.

As illustrated in FIGS. 6–12, the cylinder block 4 has sleevelike cylinder-retaining sections 30 provided at an upper portion thereof for press-fitting the sleevelike cylinders 24 therein. A plurality of block-side journal sections or walls 32 are arranged parallel to each other in spaced relation in the lengthwise extent of the block 4 below the cylinder-retaining sections 30. The journal sections 32 are disposed generally between the cylinders and are oriented in a direction perpendicular to axis A of the crankshaft 10. Block-side skirt sections 34 in a wall form are provided at opposite ends of the block-side journal sections 32, which skirt sections extend lengthwise of the block generally parallel to the crankshaft 10. The block-side skirt sections 34 at opposite ends of the journal sections 32 are opposed to one another. The skirt section 34 is formed by being curved outwardly as it extends downwardly so as to enclose peripheral loci "L" (FIGS. 1–2) defined by the rotation of the connecting rods 20, and further to form part of a substantially egg-like cross-sectional configuration expanded downwardly by a curvilinear surface whose radius is smaller at successively higher positions. In the cylinder block 4, a pair of ribs 36 is provided at each end of each block-side journal section 32. One end of each of the adjacent pair of ribs 36 is connected to the journal section 32, while the other ends thereof, which extend in an outwardly spreading manner, are linked to the block-side skirt section 34.

Figure 10:
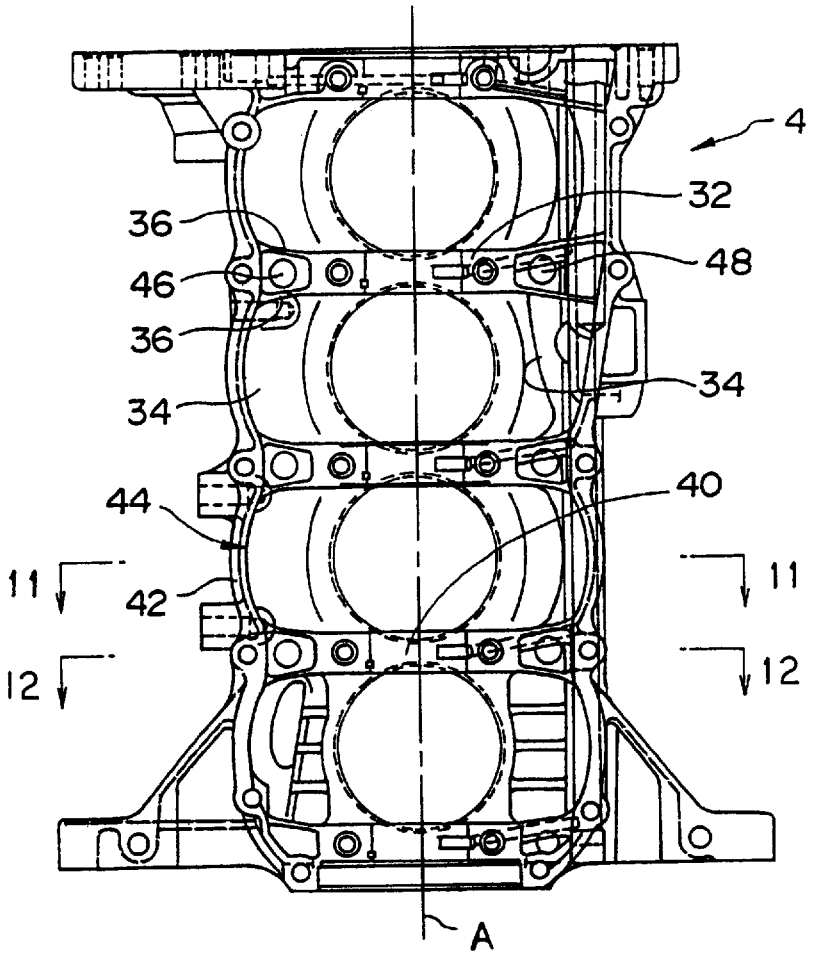
FIG. 10 is a bottom view illustrating the cylinder block.
Figure 11:
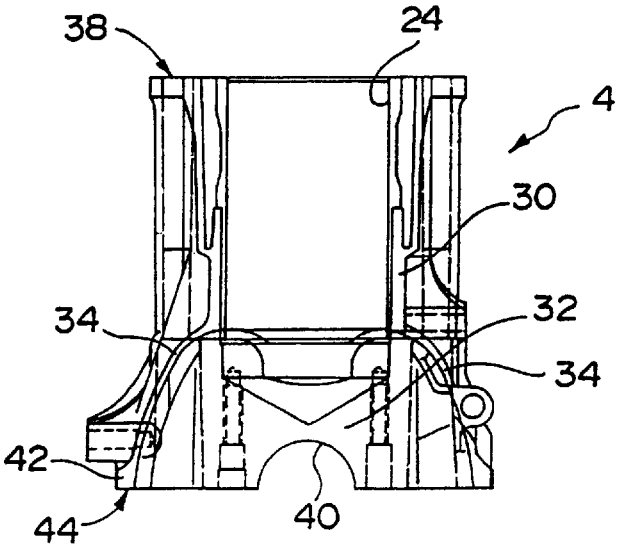
FIG. 11 is a cross-sectional view taken along line 11—11 of FIG. 10 and illustrating the cylinder block.
Figure 12:
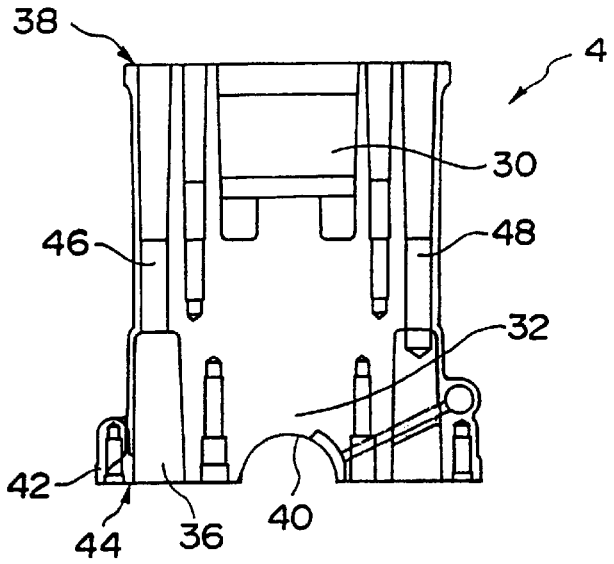
FIG. 12 is a cross-sectional view taken along line 12—12 of FIG. 10 and illustrating the cylinder block.

As illustrated in FIGS. 10–12, the cylinder block 4 has a head-mating surface 38 provided on the top of the cylinder-holding sections 30. The journal sections 32 are provided with arcuate block-side bearing surfaces 40 for rotatably supporting the crankshaft 10. Further, a lower case-mating part 42 is provided along the lower edge of the skirt section 34, and a lower case-mating surface 44 is provided on the bottom of the mating part 42. The cylinder block 4 also has a block-side blow-by gas passage 46 and a block-side oil drop passage 48 arranged at opposite ends of the journal section 32 in a direction perpendicular to the crankshaft 10. These passages 46 and 48 extend through the journal section 32 from the head-mating surface 38 to the lower case-mating surface 44 between the pair of adjacent ribs 36.

Referring now to FIGS. 4 and 5, the cylinder head 6 is shown having the following located in a head body 50: an intake port 52 and an exhaust port 54; an intake valve 56 and an exhaust valve 58 for opening and closing the preceding ports 52 and 54, respectively; and a valve-driving mechanism 62 disposed in a valve drive chamber 60 within the head body 50. The cylinder head 6 has a block-mating surface 64 disposed at the bottom of the head body 50, while having a cover-mating surface 66 positioned on the top of the head body 50. The cylinder head 6 has a head-side blow-by gas passage 68 extending through the head body 50 from the block-mating surface 64 to the cover-mating surface 66. The passage 68 communicates with the block-side blow-by gas passage 46. In addition, the cylinder head 6 has a head-side oil drop passage 70 provided therein for providing communication between the valve drive chamber 60 and the block-side oil drop passage 48.

As illustrated in FIGS. 4 and 5, the head cover 8 has a breather chamber 74 provided in a cover body 72. The breather chamber 74 communicates with the head-side blow-by gas passage 68. The cover body 72 is bottomless, but is cap shaped. In addition, a head-mating surface 76 is provided on the bottom of the cover body 72. The breather chamber 74 communicates with one of an intake system or, e.g., a throttle body (not shown).

Turning now to FIGS. 13–17, the lower case 12 is illustrated and has a plurality of case-side journal sections or walls 78 arranged parallel to each other in spaced relation in the lengthwise extent of the case for rotatably supporting the crankshaft 10 in conjunction with the block-side journal sections 32. The journal sections 78 are oriented in the direction perpendicular to the axis of the crankshaft 10. Case-side skirt sections 80 in the form of walls are provided at opposite ends of the case-side journal sections 78. The skirt sections 80 are opposed to one another, and extend lengthwise of the case in the axial direction of the crankshaft 10. The case-side journal section 78 is provided with an arcuate case-side bearing surface 82 for rotatably supporting the crankshaft 10. The case-side skirt section 80 is formed by being curved outwardly so as to extend continuously from the block-side skirt section 34 and encircle peripheral loci "L" of the connecting rods 20, and forms part of a substantially egg-like cross-sectional configuration expanded upwardly and collapsed downwardly by a curvilinear surface whose radius is greater at successively lower positions.

Figure 3:
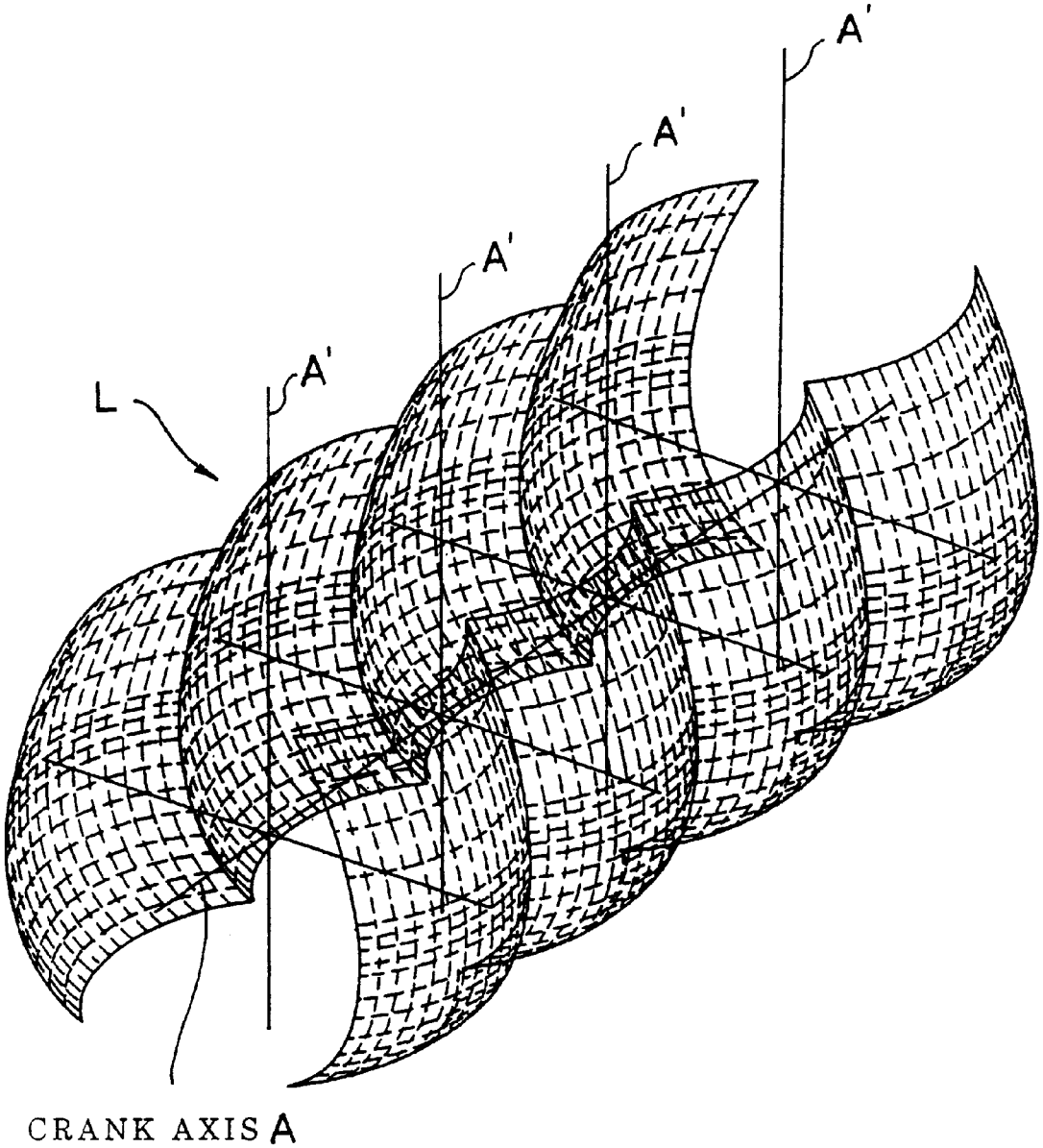
FIG. 3 is an illustration showing peripheral loci of connecting rods in the engine.

As a result, the cylinder block 4 and the lower case 12 are provided with the block-side skirt sections 34 and the case-side skirt sections 80, respectively. These skirt sections 34 and 80 are outwardly flexed, as seen from FIG. 1, so as to permit the crank chamber 18 to enclose peripheral loci "L" of the connecting rods 20, as illustrated in FIG. 3, and further to permit the crank chamber 18 to be formed by the curvilinear surface whose radius is smaller at successively higher positions, but is greater at successively lower positions, thereby providing a substantially egg-like cross-sectional shape.

Figure 2:
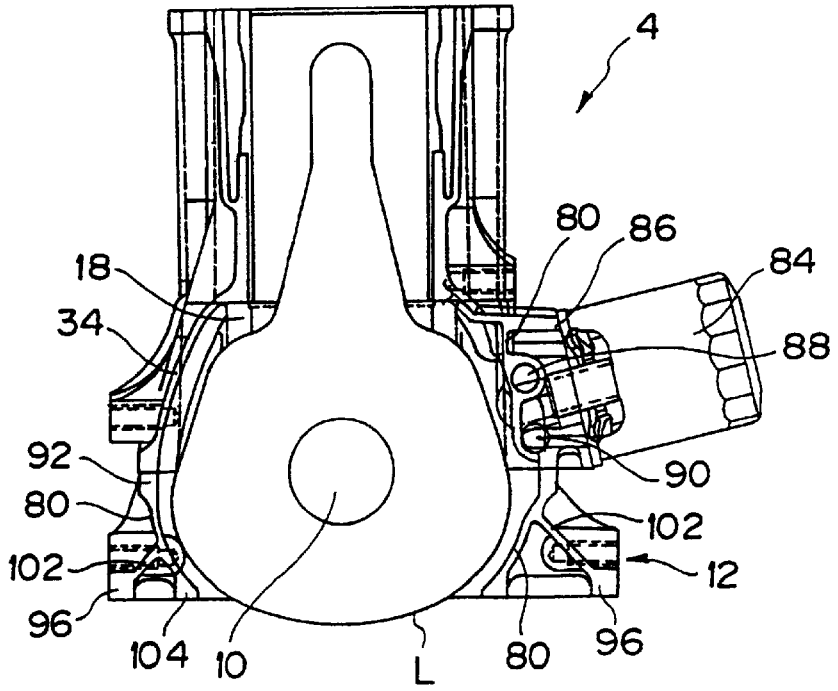
FIG. 2 is a cross-sectional view showing a portion of the engine in which a strainer-mounting boss portion is provided.

In this connection, as illustrated in FIG. 2, when the cylinder block 4 is provided with a filter-mounting boss portion 86 for mounting an oil filter 84 thereon, a main oil gallery 88, a sub-oil gallery 90, and the like, then the block-side skirt sections 34 and the case-side skirt sections 80 are configured to encircle peripheral loci "L" and further to avoid interfering with the connecting rods 20.

Figure 14:
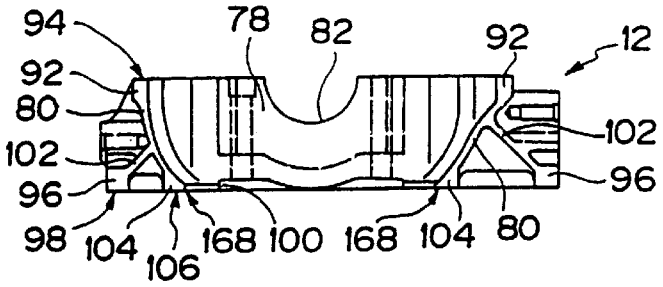
FIG. 14 is a cross-sectional view taken along line 14—14 of FIG. 13 and showing the lower case.

As shown in FIG. 14, the lower case 12 has a block-mating part 92 disposed on the upper edge of the case-side skirt section 80. A block-mating surface 94 is defined on the top of the block-mating part 92. In addition, an oil pan-mating section 96 is positioned at an outwardly oriented lower portion of the case-side skirt 80, with an oil pan-mating surface 98 being defined on the bottom of the oil pan-mating section 96. The case-side skirt sections 80 in the lower case 12 are collapsed so as to taper inwardly as they project downwardly toward the oil pan-mating surfaces 98, whereby the lower case 12 is provided with the openings 100 which communicate with the oil pan 14.

The lower case 12 has a case-side outer skirt section 102 positioned outside each of the case-side skirt sections 80 for connecting a substantially midway portion of the case-side skirt section 80 with the oil pan-mating section 96. As a result, in the lower case 12, the skirt sections 80 and the outer skirt sections 102 form a substantially inverted "V"-like cross-sectional shape and a substantially inverted "V"-like cross-sectional shape in an opposed relationship to one another. In this embodiment, the case-side outer skirt sections 102 on the right and left sides differ in position with reference to the case-side skirt sections 80 so as to change a supporting direction.

Figure 16:
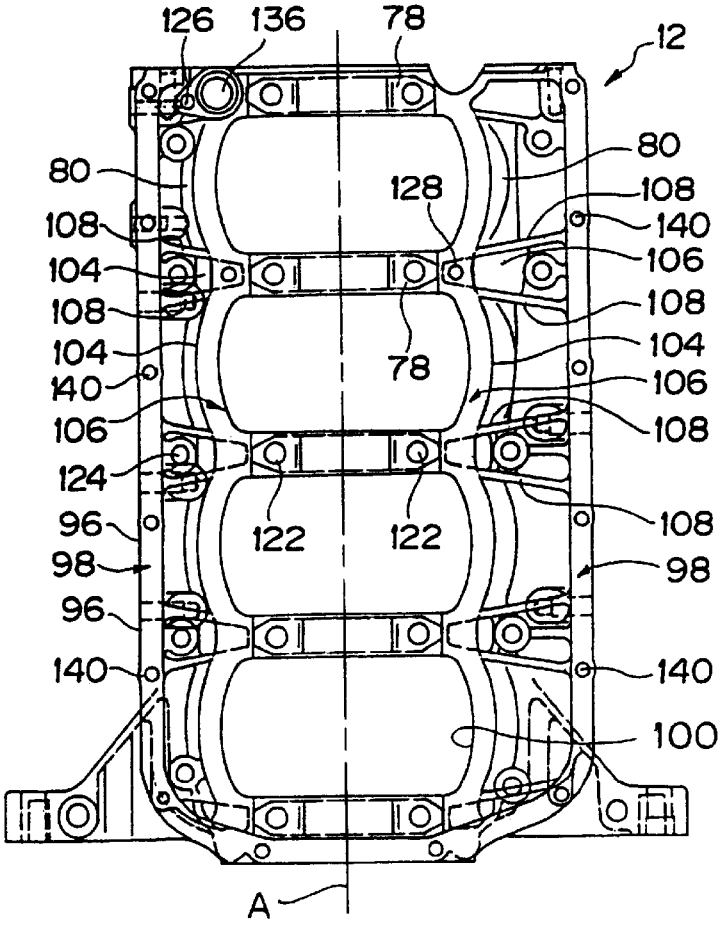
FIG. 16 is a bottom view illustrating the lower case.

As illustrated in FIGS. 14 and 16, a case-side bearing beam 104 is provided in the lower case 12 for connecting the case-side journal section 78 to the oil pan-mating surface 98 of the case-side skirt section 80. The bearing beam 104 is larger in width than the case-side skirt section 80. The bearing beam 104 mates with the shape of the case-side skirt section 80 at the oil pan-mating surface 98. As previously mentioned, the skirt section 80 is curved outwardly so as to form part of the substantially egg-like cross-sectional shape. The bearing beam 104 is curved such that a portion of the bearing beam 104 connecting with the journal section 78 is located at an inward direction close to the axis of the crankshaft 10, while a portion of the bearing beam 104 between the case-side journal sections 78 is situated in an outward direction away from the axis of the crankshaft 10.

The bearing beam 104 has a case-side beam-mating surface 106 provided on the bottom thereof. The mating surfaces 106 are provided so as to be substantially equal in height to and coplanar with the oil pan-mating surfaces 98.

As seen from FIG. 16, the lower case 12 has a pair of adjacent ribs 108 provided at each end of each of the case-side journal sections 78. First ends of the pair of ribs 108 are linked to respective portions where ends of the case-side journal section 78 and the case-side bearing beam 104 are connected together. The other or second ends of the pair of ribs 108 extend in an outwardly spreading or V-like manner, and are further linked respectively to the block-mating sections 92 and the oil pan-mating sections 96. The pair of ribs 108 is connected at the other ends to both of the case-side skirt sections 80 and the case-side outer skirt sections 102, and are further provided so as to fit to the corresponding pairs of ribs 36 in the cylinder block 4 at the block-mating sections 92.

Figure 15:
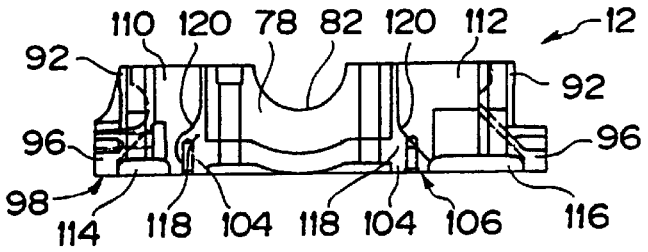
FIG. 15 is a cross-sectional view taken along line 15—15 of FIG. 13 and showing the lower case.

As illustrated in FIG. 15, a case-side blow-by gas passage 110 and a case-side oil drop passage 112 are provided between the pair of ribs 108 disposed at both ends of the case-side journal section 78. These passages 110 and 112 extend through the journal section 78 from the block-mating surface 94 to the oil pan-mating surface 98. The passages 110 and 112 communicate with the block-side blow-by gas passage 46 and the block-side oil drop passage 48, respectively. In addition, the passages 110 and 112 respectively have a passage inlet 114 and a passage outlet 116 respectively provided at the oil pan-mating surface 98. The inlet and outlet 114, 116 are open to the oil pan 14.

Respective protrusions 118 are provided in the inlet 114 and outlet 116 at locations where the case-side bearing beams 104 are connected therewith. The protrusions 118 have respective slanted surfaces 120 in the inlet 114 and the outlet 116. The slanted surface 120 projects outwardly so that the surface 120 is spaced apart from the axis of the crankshaft 10. Further, the slanted surface 120 is beveled inwardly from the oil pan-mating surface 98 toward the block-mating surface 94 so that the surface 120 is closer to the axis of the crankshaft 10. As a result, the passage inlet 114 and outlet 116 are positioned offset outwardly and away from the crankshaft 10. Further, the inlet 114 and outlet 116 are smaller in cross-sectional area than both of the case-side blow-by gas passage 110 and the case-side oil drop passage 112.

As shown in FIG. 5, the following passages are arranged respectively in the lower case 12, the cylinder block 4, and the cylinder head 6 so as to be in substantially linear communication with each other: the case-side blow-by gas passage 110; the block-side blow-by gas passage 46; and the head-side blow-by gas passage 68.

Figure 13:
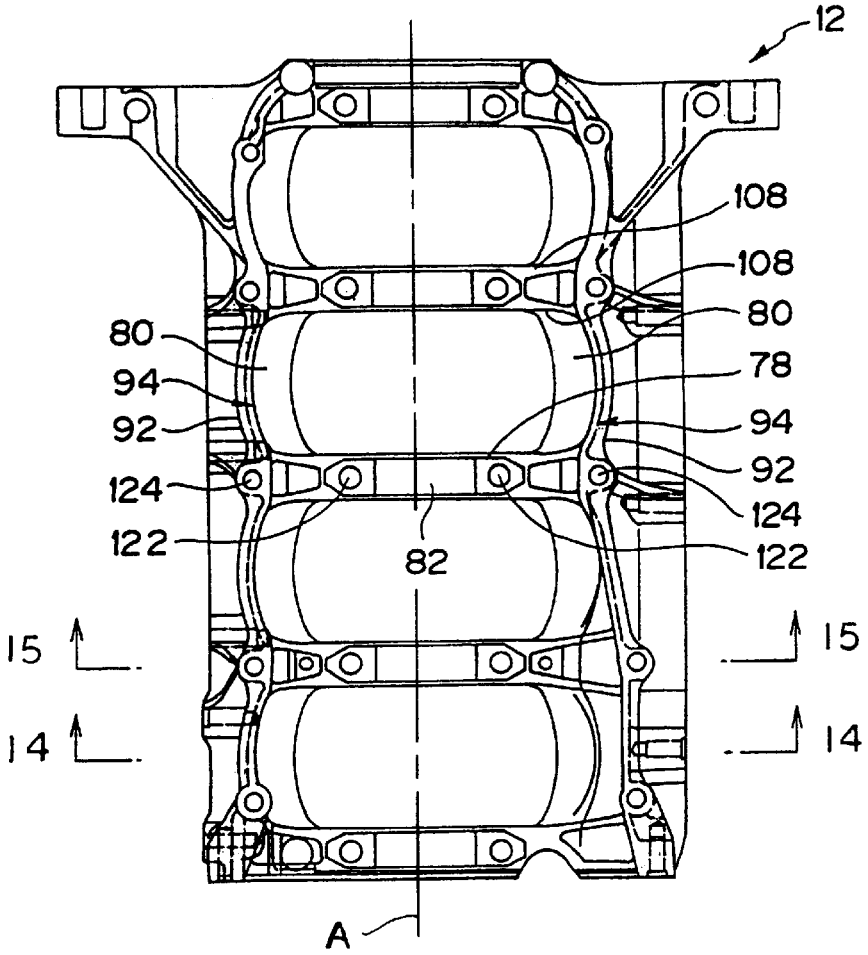
FIG. 13 is a plan view illustrating the lower case.

Referring now to FIGS. 13 and 16, the lower case 12 includes a case-side first-mounting boss portion 122 disposed on the journal section 78 on each side of the case-side bearing surface 82 for mounting the lower case 12 onto the cylinder block 4. A case-side second-mounting boss portion 124 is located outwardly from the first boss portion 122 for mounting the lower case 12 onto the cylinder block 4. As illustrated in FIG. 13, the second boss portions 124 are arranged in such a manner that the block-mating surfaces 94 are located on each line which extends between the centers of the second boss portions 124. In addition, as shown in FIG. 16, the second boss portions 124 are arranged so as to be situated between the oil pan-mating sections 96 and the case-side bearing beams 104, and are further connected to the oil pan-mating sections 96 and the pairs of ribs 108.

As shown in FIG. 16, the lower case 12 has a strainer-mounting boss portion 126 provided on one particular journal section 78 which is located at an outermost end portion of the lower case 12 in the axis direction of the crankshaft 10. More specifically, the strainer-mounting boss portion 126 is positioned on the case-side beam-mating surface 106 at a portion where the journal section 78 is connected to the case-side bearing beam 104. In addition, a bracket-mounting boss portion 128 is provided on another journal section 78 next to the above-identified journal section 78. More specifically, the bracket-mounting boss portion 128 is situated on the case-side beam-mating surface 106 at a portion where the journal section 78 is connected to the case-side bearing beam 104.

Figure 17:
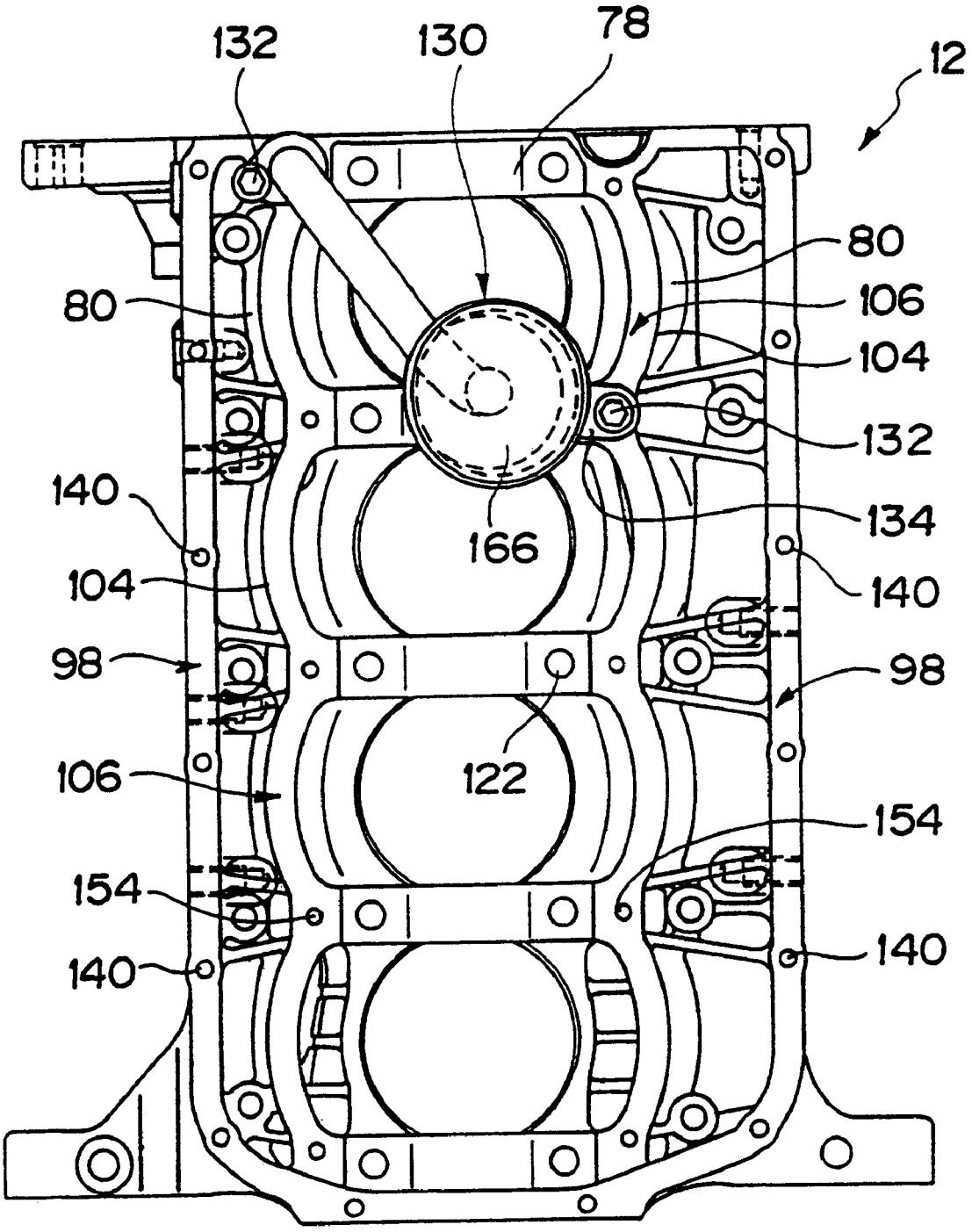
FIG. 17 is a bottom view illustrating the lower case having an oil strainer mounted thereon.

As illustrated in FIG. 17, an oil strainer 130 is mounted directly on the strainer-mounting boss portion 126 by means of a mounting bolt 132. Meanwhile, the oil strainer 130 is fitted indirectly onto the bracket-mounting boss portion 128 through a strainer-adapted bracket 134 by means of a further mounting bolt 132. In FIG. 16, reference numeral 136 denotes an oil-introducing passage. As seen from FIG. 4, this passage 136 communicates with the oil pump 138.

Referring again to FIGS. 16 and 17, the lower case 12 is illustrated having oil pan-mounting boss portions 140 provided on the oil pan-mating surface 98 for mounting the oil pan 14 onto the lower case 12.

As illustrated in FIGS. 4 and 5, the oil pan 14 has an upright peripheral wall portion 144 extending around the bottom wall 142, and further has a case-mating section or flange 146 disposed on the top edge of the peripheral wall portion 144. The case-mating section 146 is provided with mounting holes 148 which mate with the oil pan-mounting boss portions 140. In addition, a case-mating surface 150 is provided on an upper surface of the case-mating section 146. The case-mating surface 150 is designed for abutting contact with the oil pan-mating surface 98. Mounting bolts 152 which are inserted through the mounting holes 148 are driven into threaded attachment with the oil pan-mounting boss portions 140. The oil pan 14 is thereby mounted on the lower case 12.

The baffle plate 16 is not fitted to the oil pan 14, but is mounted on the lower case 12. Referring back to FIG. 17, the lower case 12 is illustrated having baffle plate-mounting boss portions 154 provided on the case-side beam-mating surfaces 106 of the bearing beams 104 for mounting the baffle pan 16 thereon.

Figure 18:
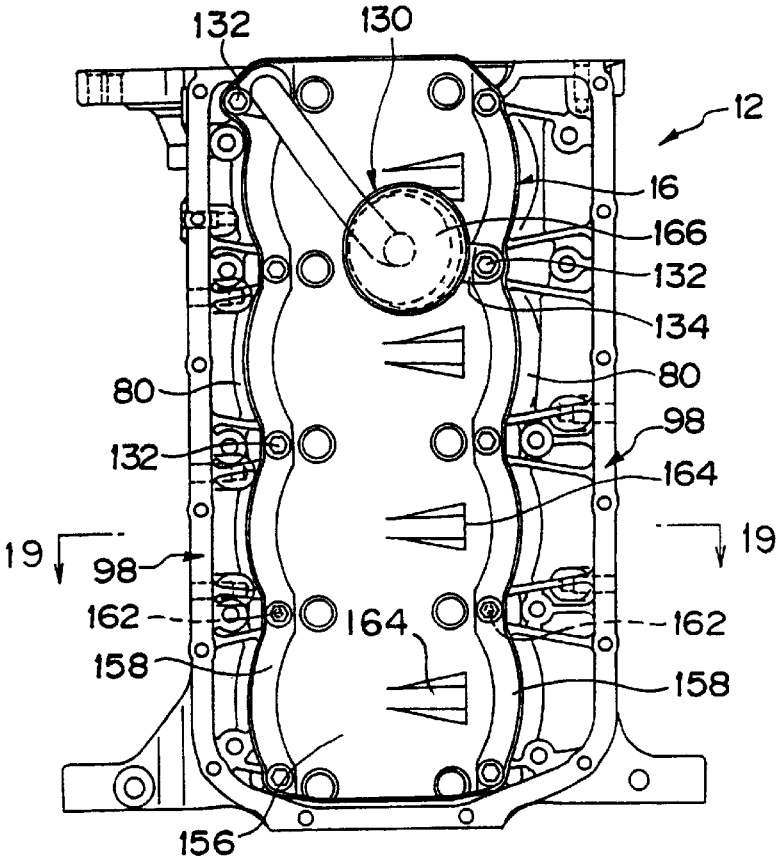
FIG. 18 is a bottom view illustrating the lower case having the oil strainer and a baffle plate mounted thereon.
Figure 19:
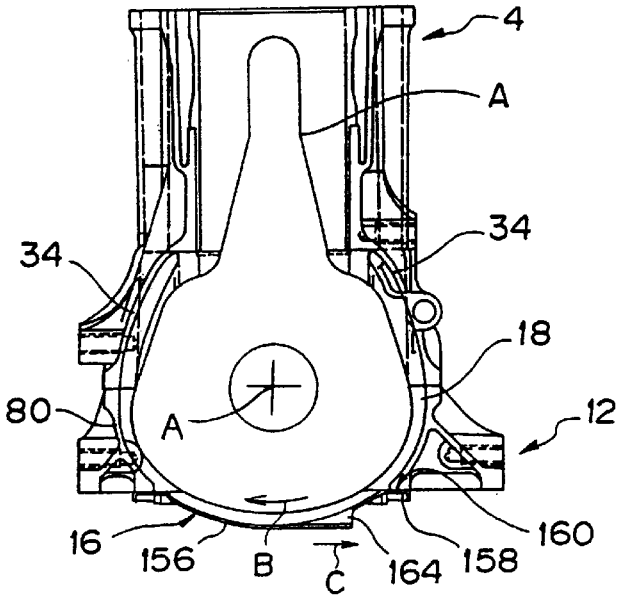
FIG. 19 is a cross-sectional view taken along line 19—19 of FIG. 18 and showing the lower case having the oil strainer and the baffle plate mounted thereon.
Figure 20:
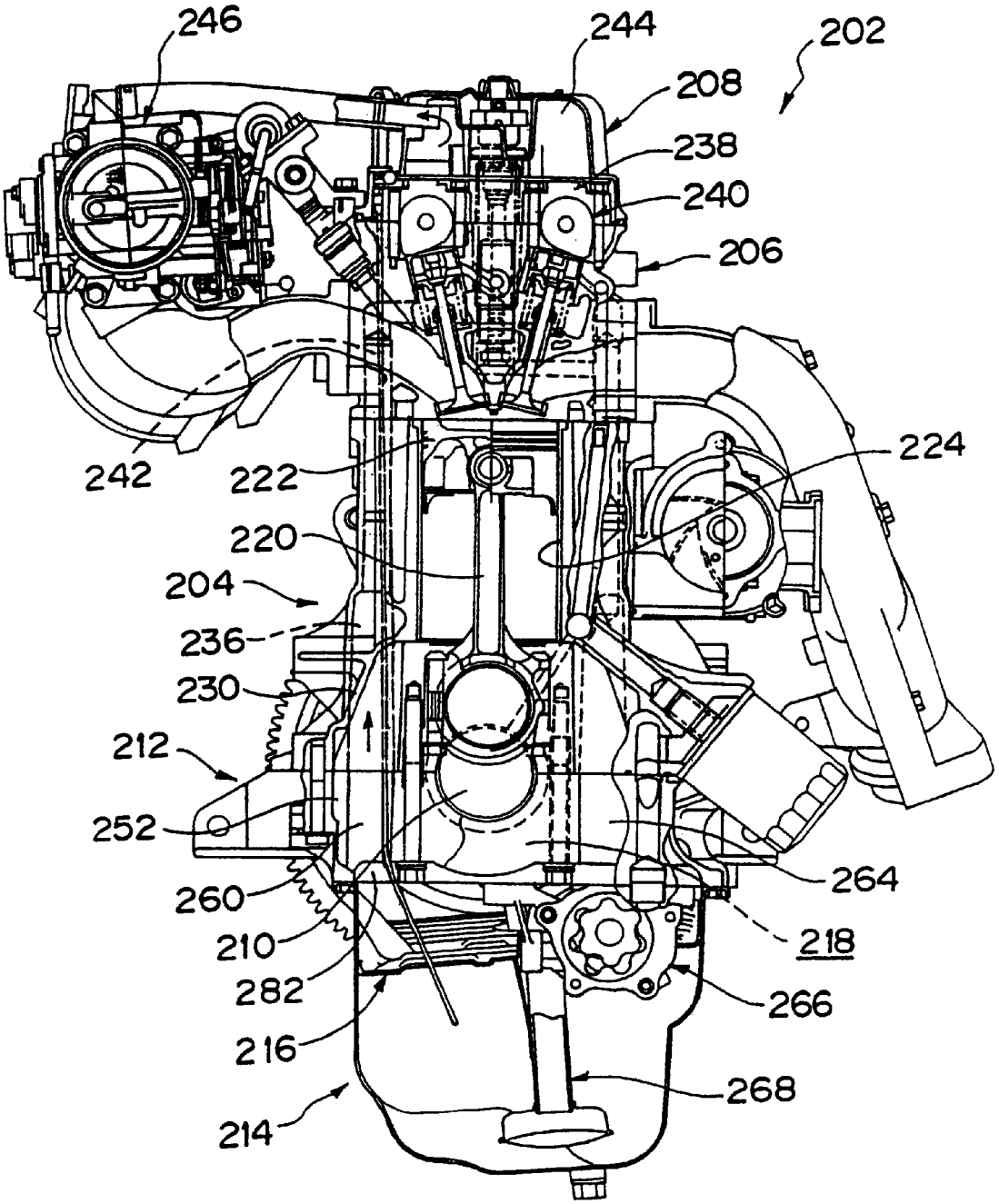
FIG. 20 PRIOR ART
FIG. 20 is a cross-sectional view illustrating an engine according to the prior art.
Figure 21:
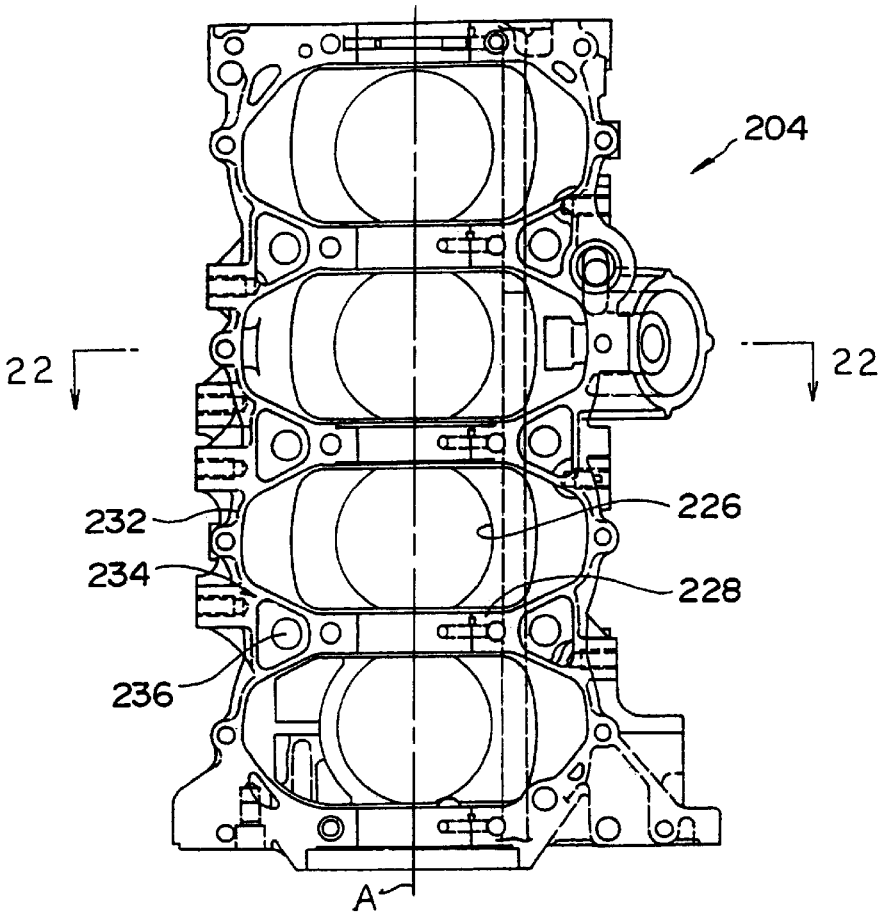
FIG.21 PRIOR ART
FIG. 21 is a bottom view illustrating a cylinder block of the engine of FIG. 20.
Figure 22:
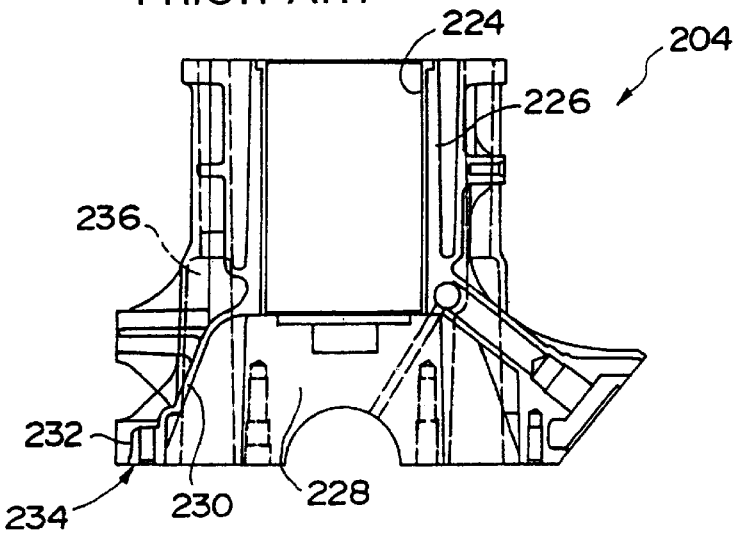
FIG.22 PRIOR ART
FIG. 22 is a cross-sectional view taken along line 22—22 of FIG. 21 and showing the cylinder block.
Figure 23:
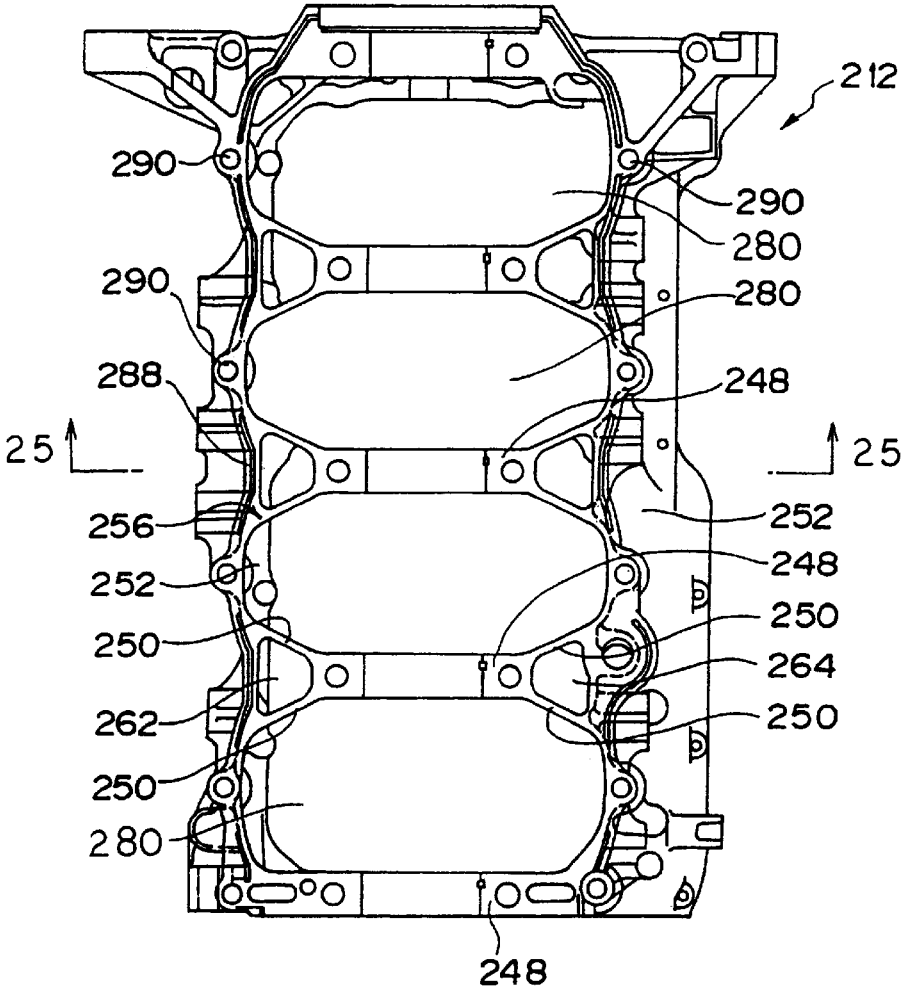
FIG.23 PRIOR ART
FIG. 23 is a plan view illustrating a lower case.
Figure 24:
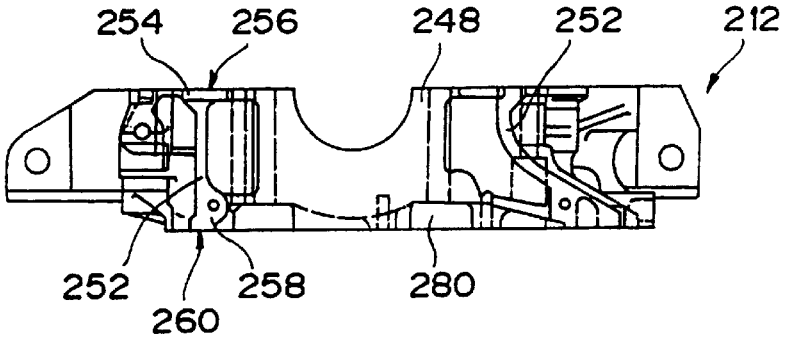
FIG.24 PRIOR ART
FIG. 24 is a front view showing the lower case of the engine of FIG. 20.
Figure 25:
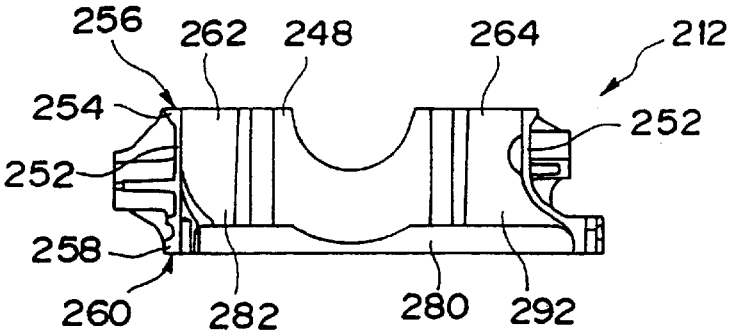
FIG.25 PRIOR ART
FIG. 25 is a cross-sectional view taken along line 25—25 of FIG. 23 and showing the lower case.
Figure 26:
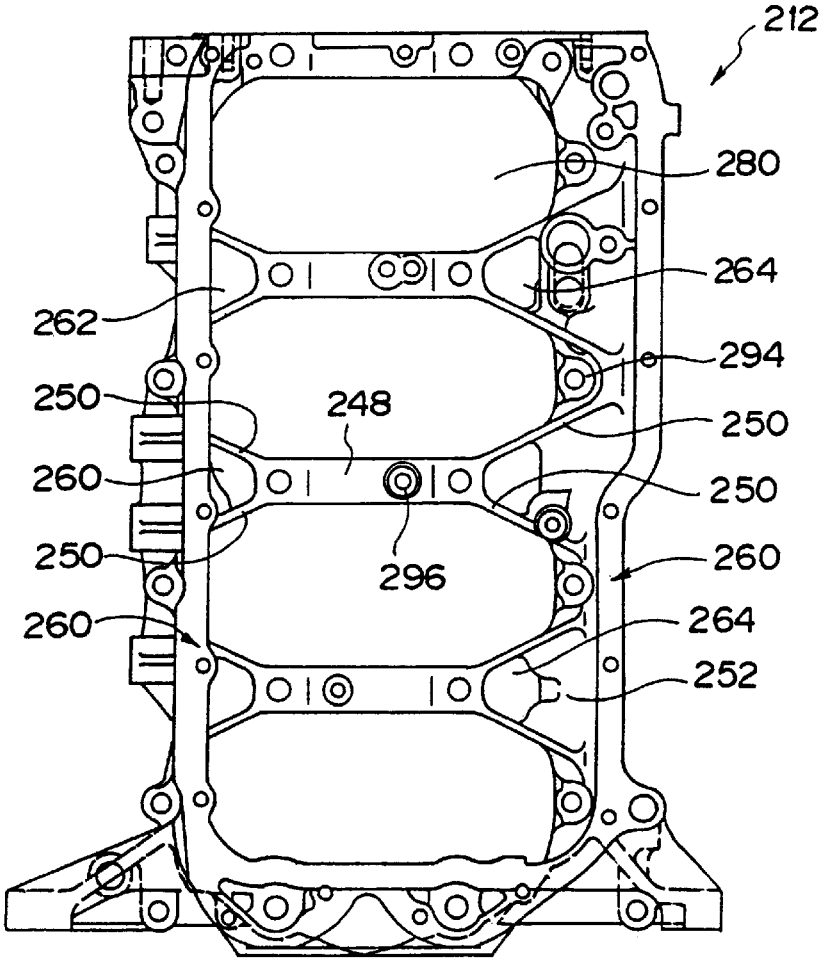
FIG.26 PRIOR ART
FIG. 26 is a bottom view showing the lower case of the engine of FIG. 20.
Figure 27:
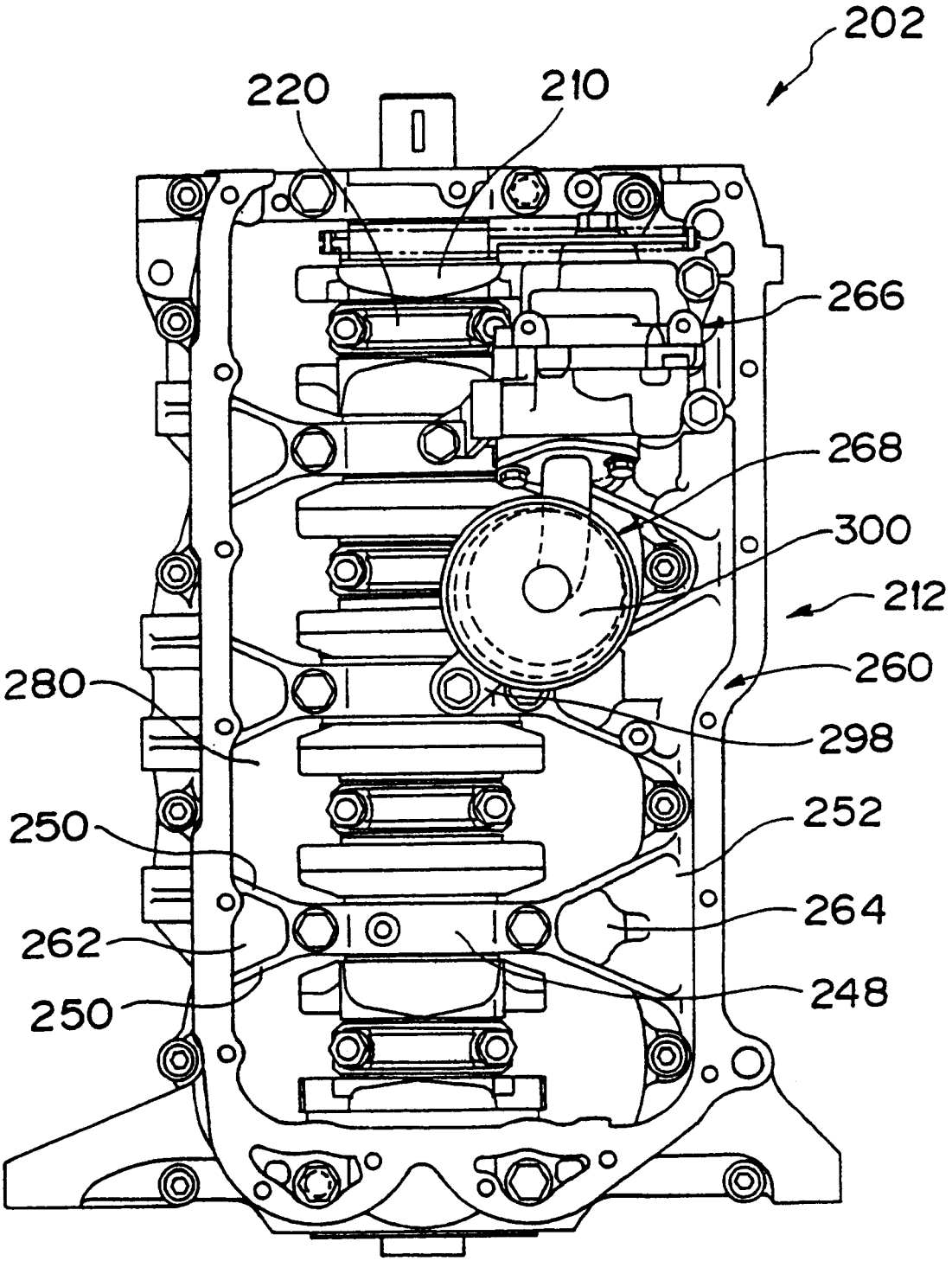
FIG. 27 PRIOR ART
FIG. 27 is a bottom view illustrating the engine of FIG. 20 having an oil strainer disposed on the lower case.

As illustrated in FIGS. 18 and 19, the baffle plate 16 is provided with: curved portions 156 extending smoothly between the opposed case-side skirt sections 80, the curved portion 156 having a curvilinear convex shape such as to form part of a substantially egg-like cross-sectional shape;

case-mating flanges or sections 158 extending around the curved portions 156, which section 158 matches in shape with the curved case-side bearing beam 104; and case-mating surfaces 160 on the case-mating sections 158, which surfaces 160 are in abutting contact with the case-side beam-mating surfaces 106.

The baffle plate 16 has mounting holes 162 provided on the case-mating sections 160. The mounting holes 162 fit to: the strainer-mounting boss portion 126; the bracket-mounting boss portion 128; and the baffle plate-mounting boss portion 154. The baffle plate 16 is mounted on the lower case 12 by way of mounting bolts 132 which are inserted through the holes 162 and brought into threaded attachment with the strainer-mounting boss portions 126, the bracket-mounting boss portions 128, and the baffle plate-mounting boss portions 154.

In the present embodiment, the oil strainer 130 and the strainer-adapted bracket 134 are fastened, together with the baffle plate 16, by means of the mounting bolts 132 in order to mount the above on the lower case 12.

In addition, as illustrated in FIG. 19, the curved portions 156 are provided with oil drop holes 164. The oil drop holes 164 are drilled through the curved portions 156 so as to be oriented in direction C opposite to the rotational direction B of the crankshaft 10.

Next, the operation of the crank chamber structure for the engine 2 will be briefly described.

Figure 1:
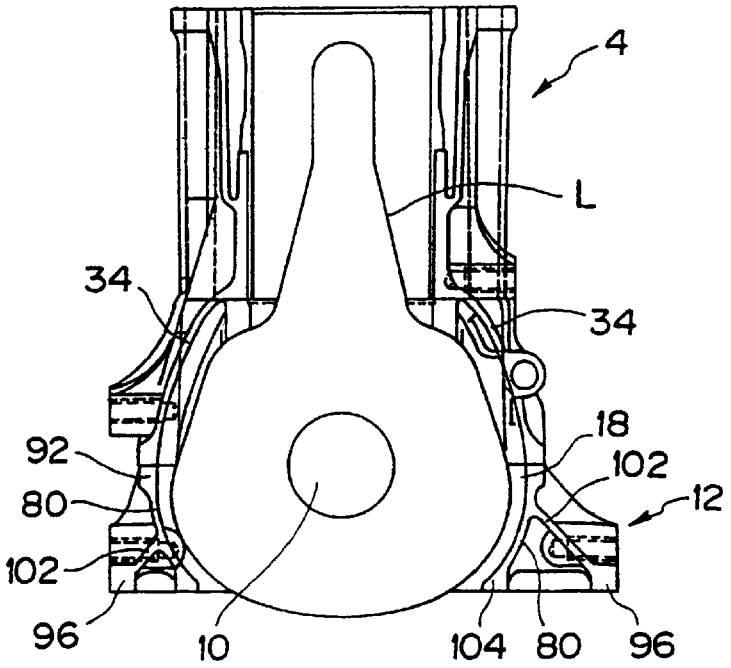
FIG. 1 is a cross-sectional view showing a crank chamber for an engine in accordance with an embodiment of the present invention.

As illustrated in FIG. 1, the crank chamber 18 of the engine 2 is provided between the cylinder block 4 and the lower case 12. The cylinder block 4 and the lower case 12 are provided with the block-side skirt sections 34 and the case-side skirt sections 80, respectively. These sections 34 and 80 are curved outwardly in such a manner that the crank chamber 18 encloses peripheral loci "L" of the connecting rods 20 linked to the crankshaft 10, as illustrated in FIG. 3. Further, the crank chamber 18 has a curvilinear surface whose radius is smaller at successively higher positions, but is greater at successively lower positions, thereby providing a substantially egg-like cross-sectional shape.

The construction of the generally egg-shaped crank chamber 18 of the present invention will now be briefly summarized.

More specifically, as illustrated by the drawings, a plurality of crank chambers 18 are disposed in adjacent relationship lengthwise along the engine so that one crank chamber is disposed below and generally aligned with each of the cylinders and the reciprocal piston supported therein. Four such crank chambers are diagrammatically illustrated in FIG. 3. Each of the crank chambers 18 has the substantially upper half thereof defined by the inner surfaces of the opposed block-side skirt portions 34, and the substantially lower half of the crank chamber is defined by the inner surfaces of the opposed case-side skirt portions 80. These skirt portions 34 and 80 have the inner surfaces thereof generated by radii which are centered about the longitudinal axis A' of the respective cylinder and piston arrangement, with the radius being generated within a plane which substantially perpendicularly intersects the respective cylinder axis A', whereby the radius generating plane is thus also generally parallel with the longitudinal crank axis A. As to the surfaces defined by the block-side skirt portions 34, the generating radius progressively decreases as the generating plane is progressively moved upwardly with respect to a plane containing the longitudinal crank axis A. Similarly, with respect to the case-side skirt portions 80, the generating radius for the inner surfaces is progressively increased as the generating plane is progressively moved downwardly below the longitudinal crank axis A for a limited distance, such as to a point approximately midway between the upper and lower surfaces of the lower case, with the radius thereafter progressively decreasing as the generating plane continues to move downwardly to the bottom surface of the lower case. This thus results in the inner surfaces of the skirt portions 34 and 80 having a shape which, in three dimensions, approaches an egg-like configuration. The resulting crank chamber 18 thus is of a decreasing cross-sectional area within planes perpendicular to the respective cylinder axis A' as these planes progressively move either upwardly or downwardly along the cylinder axis A' from the plane of maximum diameter, which plane is disposed vertically between the upper and lower surfaces of the lower case. With this arrangement, when the crank chamber is viewed within any plane which is perpendicular to the cylinder axis A', which plane is hence also parallel to the crankshaft axis A, the opposed side walls of the crank chamber (as defined on either skirt portions 34 or skirt portions 80) are accordingly of an outward or concave curvature so that the horizontal sideward spacing or distance between the opposed inner surfaces is greater at the middle than it is at the ends as shown by the diagrammatic illustrations of FIG. 3. This overall curvature for the walls defining the crank chamber thus permits the minimization of the volume of the crank chamber and hence results in the structural and operational advantages described herein.

Thus, in the crank chamber structure, the block-side skirt sections 34 and the case-side skirt sections 80 are expanded and curved outwardly so as to permit the crank chamber 18 to enclose loci "L" of the connecting rods 20, and further to provide the substantially egg-like cross-sectional shape. Such a cross-sectional shape approaches a spherical surface so that it is possible to provide improved rigidity of the crank chamber 18 as well as a smaller surface area of the chamber 18. In addition, the aforesaid cross-sectional shape makes it possible to provide a smooth flow of rotational wind caused by revolutions of the crankshaft 10 and the connecting rods 20, and to reduce the cubic volume of gases in the crank chamber 18.

As a result, in the crank chamber structure, the improved rigidity of the crank chamber 18 can reduce vibratory noise caused by running of the engine 2, and the reduced surface area of the crank chamber 18 can realize a light-weight crank chamber structure at low cost. In addition, air resistance, which is caused by stirred gases incurred with respective rotations of the crankshaft 10 and the connecting rods 20, can be lessened to reduce a loss of power output from the engine 2 because the rotational wind caused by respective revolutions of the crankshaft 10 and the connecting rods 20 can be made smoother, and further because the cubic volume inside the crank chamber 18 can be made smaller.

In addition, in the crank chamber structure, the case-side skirt sections 80 which are opposed to one another are collapsed so as to taper inwardly toward one another as they extend down to the oil pan-mating surface 98, whereby the lower case 12 is provided with the openings 100 which communicate with the oil pan 14. As a result, a spray of oil which is blown from both of the crankshaft 10 and the connecting rods 20 can be drawn directly into the oil pan 14 in reduced amounts, with a consequential reduction in aeration and oil mist, both of which occur in the oil pan 14.

Consequently, in the crank chamber structure, the aeration in the oil drawn from the oil strainer 130 and then fed to each section of the engine 2 by means of the oil pump 138 can be reduced in amounts, resulting in enhanced lubricating performance of the engine 2. In addition, the oil mist, which is moved together with blow-by gas into the breather chamber 74 inside the head cover 8, can be reduced in amounts, and thus the breather chamber 74 can be made smaller in cubic volume. As a result, the engine 2 may be reduced in height, and can be made lighter in weight and lower in cost, with a consequential improvement in such a convenience as to load the engine 2 into an engine compartment (not shown) of a vehicle.

In the crank chamber structure, the lower case 12 is provided with the case-side bearing beams 104 for connecting the case-side journal portions 78 with the oil pan-mating surfaces 98 of the case-side skirt sections 80. The bearing beam 104 is curved in such a manner that portions of the bearing beam 104 connecting with the journal section 78 are situated inwardly, while portions of the bearing beam 104 disposed between the journal sections 78 are located or curved outwardly.

In the crank chamber structure, since the outwardly curved case-side bearing beams 104 are provided for connecting the case-side journal sections 78, it is possible to provide the bearing beams 104 whose rigidity is high enough to reinforce the journal sections 78 with the aid of the skirt sections 80 of the lower case 12. Such a curved formation of the bearing beams 104 makes it possible to provide the crank chamber structure with a shape closest to peripheral loci "L" of the connecting rods 20. In addition, the case-side bearing beams 104 are curved to lie closer to the case-side journal sections 78, whereby the supporting rigidity of the journal sections 78 in the axis direction of the crankshaft 10 can be enhanced. As a result, when the engine 2 is run, the crank chamber structure is capable of resisting deformation of the journal sections 78 in the axis direction of the crankshaft 10, with a concomitant reduction in vibratory noise.

Figure 30:
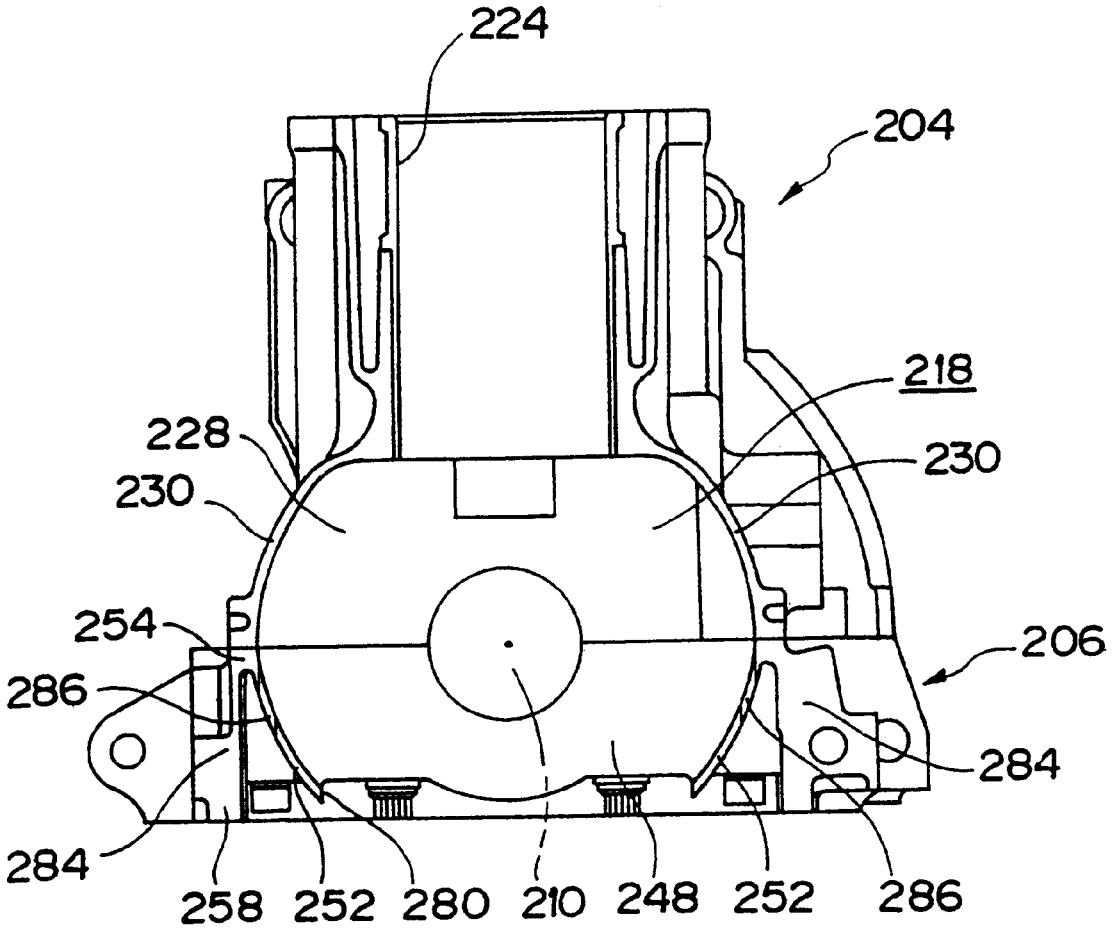
FIG.30 PRIOR ART
FIG. 30 is a cross-sectional view illustrating a crank chamber for an engine as another example of the prior art.

In the crank chamber structure, the lower case 12 has the case-side outer skirt sections 102 provided outwardly from the case-side skirt sections 80 for connecting substantially midway portions of the skirt sections 80 with the oil pan-mating sections 96. In the crank chamber structure, since the case-side outer skirt sections 102 are arranged outwardly from the skirt sections 80, then the case-side skirt sections 80 and the case-side outer skirt sections 102 allow the lower case 12 to form a substantially inverted "V"-like cross-sectional shape and a substantially inverted "V"-like cross-sectional shape in an opposed relationship to one another, as illustrated in FIG. 1. As a result, the bending rigidity of the lower case 12 in longitudinal and transverse directions thereof can be increased, and deformation of the oil pan-mating surfaces 98 can be prevented or at least minimized when the engine 2 is run. In addition, the lower case 12 can be made lighter in weight, when compared with a conventional lower case having a "reversed V-shaped cross section" (see FIG. 30).

Consequently, with this crank chamber structure it is possible to reduce noises from the lower case 12, the oil pan 14, and the baffle plate 16 because of the improved rigidity of the lower case 12 as well as control deformation of the oil pan-mating surfaces 98. In addition, the baffle plate 16 can be disposed on the oil pan 14 and can be secured thereto at fewer spots. The baffle plate 16 can be made smaller in thickness. As a result, the light-weight baffle plate 16 having fewer fixing spots thereon is achievable. In addition, the lower case 12 can be made lower in cost as well as being made lighter in weight.

In the crank chamber structure, the lower case 12 is provided with pairs of ribs 108, whose one ends are connected to respective portions of the lower case 12 where the journal sections 78 and the bearing beams 104 are connected together. The other ends of the pair of ribs 108 extend in an outwardly spreading manner, and are linked respectively to the block-side mating sections 90 and the oil pan-mating sections 94. In addition, the case-side blow-by gas passage 110 and the case-side oil drop passage 112 are positioned between the pair of ribs 108. Further, a passage inlet 114 and a passage outlet 116 of the passages 110 and 112, respectively, at the oil pan-mating surface 98 are positioned offset outwardly by means of the protrusions 118. Moreover, the protrusions 118 enable the inlet 114 and outlet 116 to be made with a smaller cross-sectional area than the case-side passages 110 and 112, respectively.

As a result, the crank chamber structure can be configured in such a manner that the oil mist, which occurs in the crank chamber 10 having the substantially egg-like cross-sectional shape, cannot be moved to the inlet 114 of the passage 110 without flowing below the case-side bearing beams 104.

Accordingly, the crank chamber structure increases the distance that the oil mist is moved from the inside of the crank chamber 10 to the inlet 114. This greater distance allows a reduced amount of the oil mist to be moved to the breather chamber 74. The breather chamber 74 can be made smaller in cubic volume. The engine 2 can be made smaller in height, and further can be made lighter in weight and at a lower cost. As a result, it is possible to provide an improved convenience in that the engine 2 is more easily disposed in the engine compartment (not shown) of the vehicle.

In the crank chamber structure, since the respective passage inlet 114 and outlet 116 of the case-side passages 110 and 112 at the oil pan-mating surface 98 are positioned offset outwardly by means of the protrusions 118, then the inlet 114 and outlet 116 are thereby spaced apart from the axis of the crankshaft 10, and oil falling into the oil pan 14 from the passage outlet 116 can be isolated from a suction opening 166 of the oil strainer 130. In addition, the passage inlet 114 can be remote from the neighborhood of the revolving crankshaft 10 where the oil mist is present in large quantities.

As a result, the crank chamber structure allows the oil strainer 130 to be resistant to draw in the aeration caused by the falling oil, because the oil dropping into the oil pan 14 can be isolated from the suction opening 166. In addition, the aeration in the supplied oil can be reduced in amounts, with consequential enhancement in the lubricating performance of the engine 2. Further, in the crank chamber structure, since the inlet 114 is remote from the neighborhood of the crankshaft 10 where the oil mist is present in large quantities, then the oil mist to be moved into the breather chamber 74 can be reduced in amount, and thus the breather chamber 74 can be made smaller in cubic volume. As a result, the engine 2 can be reduced in height, and can be made lighter in weight and at a lower cost, with a consequential improvement in convenience of mounting the engine 2 into the engine compartment (not shown) of the vehicle.

Moreover, since the aforesaid passage inlet 114 and outlet 116 are made smaller in cross-sectional area than the case-side passages 110 and 112, respectively, by means of the protrusions 118, then the crank chamber structure allows the velocities of gases to be accelerated by means of the inlet 114 having a smaller cross-sectional area, and thereafter to be decelerated by means of the case-side blow-by gas passage 110 having a larger cross-sectional area. Similarly to the breather chamber 74 inside the head cover 8, the crank chamber structure is allowed to function as a separator.

Consequently, the aforesaid case-side passage 110 and the inlet 114 permit the crank chamber structure to function as a breather chamber. As a result, the oil mist blown into the breather chamber 74 can be reduced in amount, and thus the breather chamber 74 in the head cover 8 can be made smaller in cubic volume.

In the crank chamber structure, the case-side blow-by gas passage 110, the block-side blow-by gas passage 46, and the head-side blow-by gas passage 68 are arranged so as to be in substantially linear communication with each other. As a result, blow-by gas is smoothly movable into the breather chamber 74 in the head cover 8 without being disrupted substantially midway along the above passages.

Thus, the crank chamber structure permits the blow-by gas to be supplied satisfactorily to the intake system of the engine 2 without allowing the blow-by gas to reside in the crank chamber 10. As a result, the gases in the crank chamber 10 are reduced in pressure. Thus, air resistance, which is caused by stirred gases incurred with respective rotations of the crankshaft 10 and the connecting rods 20, can be lessened, with a concomitant reduction in output power loss of the engine 2.

Figure 28:
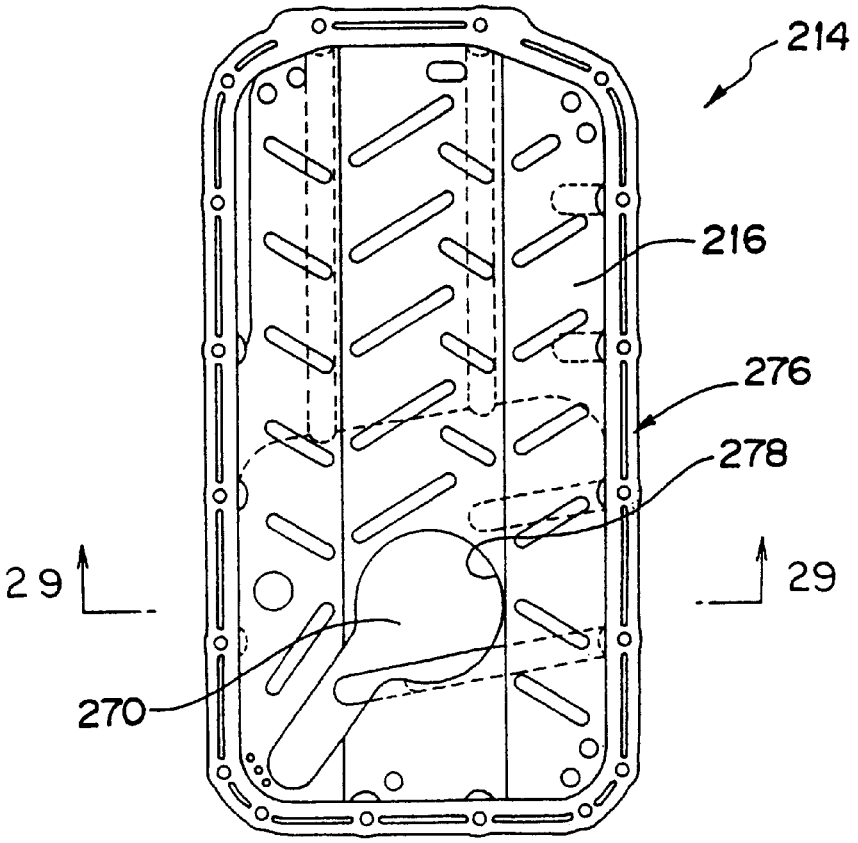
FIG.28 PRIOR ART
FIG. 28 is a plan view showing an oil pan for the engine of FIG. 20.
Figure 29:
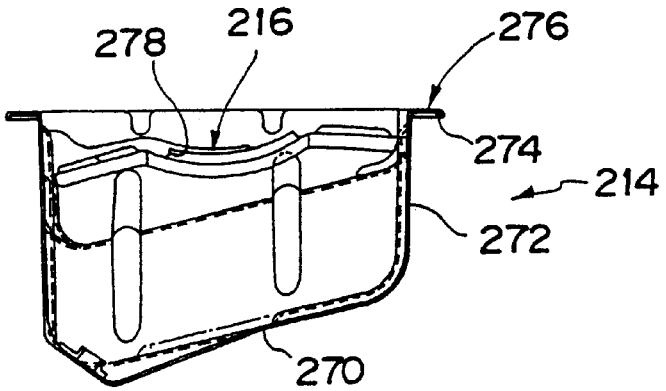
FIG.29 PRIOR ART
FIG. 29 is a cross-sectional view taken along line 29—29 of FIG. 28 and showing the oil pan.

In the crank chamber structure, the baffle plate 16 is provided for covering the openings 100 of the lower case 12, and further for forming the crank chamber 18 in cooperation with the block-side skirt sections 34 and the case-side skirt sections 80. The crank chamber 18 has a substantially egg-like cross-sectional shape. The baffle plate 16 is mounted on the case-side bearing beams 104. As a result, the baffle plate 16 is not mounted on the oil pan 14. In addition, the baffle plate 16 need not be provided with a strainer-adapted hole (see FIG. 28) which is normally punched for inserting the oil strainer 130 through the strainer-adapted hole. The baffle plate 16 can be made smaller in dimension, when compared with that on the oil pan 14. In addition, the baffle plate 16 can be formed into a smooth curvilinear surface shape which continuously extends from and defines the bottom of the substantially egg-like cross-sectional shape of the crank chamber 18. As a result, the inner cubic volume of the crank chamber 18 can be reduced.

Thus, the crank chamber structure can be made smaller in dimension, lighter in weight, and lower in cost because the baffle plate 16 is not disposed on the oil pan 14. Further, in the crank chamber structure, the oil falling into the oil pan 14 can be isolated from the suction opening 166 of the oil strainer 130 because the strainer-adapted hole is not provided for inserting the oil strainer 16 therethrough. Consequently, the oil strainer 130 can be rendered immune to admit the aeration caused by such falling oil. In addition, the aeration in the supplied oil can be reduced in amount, and the engine 2 can be provided with improved lubricating performance.

Further, since the baffle plate 16 can be made compact, then the crank chamber structure can be made smaller in dimension, lighter in weight, and lower in cost. Further, since the baffle plate 16 can be formed so as to have a smooth curvilinear surface shape which continuously extends in a substantially egg-like cross-sectional shape, then the rotational wind caused by respective revolutions of the crankshaft 10 and the connecting rods 20 can be rendered smoother. In addition, the cubic volume inside the crank chamber 10 can be made smaller. As a result, it is possible to lessen the air resistance which is caused by stirred gases involved in respective rotations of the crankshaft 10 and the connecting rods 20. The engine 2 thereby experiences a reduced output loss.

Further, since the baffle plate 16 can be formed with the smooth curvilinear surface shape which continuously extends and defines in the substantially egg-like cross-sectional shape, then the baffle plate 16 can be provided with improved rigidity, with the result that noise from the running engine 2 can be reduced. In addition, the oil pan 14 is partitioned from the crank chamber 18, thereby providing a reduced pressure variation. Such a small variation makes it possible to lessen influences which are caused by variations in pressure to be applied to the intake system of the engine 2 through the blow-by gas passages.

Moreover, the oil strainer 130 and the strainer-adapted bracket 134 are fastened and mounted on the lower case 12 together with the baffle plate 16 by means of mounting bolts 132. As a result, a reduced number of the mounting bolts 132 are usable, and thus fewer assembling processes are achievable. Thus, the lightweight crank chamber structure is attainable at reduced cost.

Further, the baffle plate 16 is provided with the oil drop holes 164 which are punched through the curved portions 156 and oriented in the direction C opposite to the rotational direction B of the crankshaft 10. As a result, the oil dropping into the oil pan 14 can be retarded in velocity. Then, the oil strainer 130 can be rendered resistant to admit the aeration caused by such falling oil. Consequently, the aeration in the supplied oil can be reduced in amount, and the engine 2 can be provided with improved lubricating performance.

In the crank chamber structure, upper and lower surfaces of the lower case 12 can be formed parallel to one another because the case-side beam-mating surfaces 106 on the bearing beams 104 of the lower case 12 are arranged so as to be substantially equal in height to the oil pan-mating surfaces 98. Consequently, in the crank chamber structure, the lower cases 12 are easily stacked one above the other when being transported and stored in factories. In addition, burrs remaining on parting surfaces 168 between upper and lower parts as illustrated in FIG. 14 can be trimmed off simultaneously when the oil pan-mating surfaces 98 are worked to form. As a result, a deburring process can be eliminated. After simultaneous working of the oil pan-mating surfaces 98 and the case-side beam-mating surfaces 106, the block-mating surfaces 94 are worked in dependence upon such worked surfaces 98 and 106. As a result, it is possible to provide enhanced accuracy of working the block-mating surfaces 94, which provides improved sealing performance between the lower case-mating surfaces 44 of the cylinder block 4 and the block-mating surfaces 94 of the lower case 12.

In the crank chamber structure, the lower case 12 has respective case-side first-mounting boss portions 122 arranged at both ends of the case-side bearing surface 82 on each of the case-side journal portions 78. In addition, respective case-side second-mating boss portions 124 are provided outwardly from the first boss portions 122. Then, the second boss portions 124 are arranged in such a manner that the block-side mating surfaces 94 are situated on each line which connects or extends between the centers of the second boss portions 124. Further, the second boss portions 124 are arranged so as to be positioned between the oil pan-mating sections 96 and the case-side bearing beams 104. In addition, the second boss portions 124 are connected to the oil pan-mating sections 96 and the pairs of ribs 108.

Accordingly, in the crank chamber structure, the pairs of ribs 36 on the cylinder block 4, the pairs of ribs 108 on the lower case 12, and the cylinder block 4, and the oil pan-mating surfaces 98 of the lower case 12 can be fixed rigidly enough to reduce vibratory noise because: the second boss portions 124 are arranged in such a manner that the block-side mating surfaces 94 are located on each line which connects between the centers of the second boss portions 124; the second boss portions 124 are further arranged so as to be positioned between the oil pan-mating sections 96 and the case-side bearing beams 104; and the second boss portions 124 are connected to the oil pan-mating sections 96 and the pairs of ribs 108.

In addition, the pair of ribs 108 and the case-side second-mounting boss portion 124 are connected together close to one another, while the pair of ribs 108 extends from the case-side journal section 78 to both of the block-mating section 92 and the oil pan-mating section 96. Such a construction can reduce vibration from the crankshaft 10 which is a source of such vibration as to be conventionally conducted to the oil pan-mating sections 96 from the case-side journal sections 78. In particular, it is possible to lessen vibratory noise of a half primary component, which is caused by crank rotation, and further which is responsible for explosion strokes of the engine 2. Then, it is possible to reduce noise from lower sections of the engine 2 such as the lower case 12, the oil pan 14, and the baffle plate 16.

In the crank chamber structure, the lower case 12 has the strainer-mounting boss portion 126 provided on one of the case-side journal sections 78 at a portion where the journal section 78 is connected to the case-side bearing beam 104. The lower case 12 further has the bracket-mounting boss portion 128 provided on another journal section 78 next to the above-identified journal section 78 at a portion where that particular journal section 78 is connected to the case-side bearing beam 104. The oil strainer 130 is mounted on the boss portion 126, while the strainer-adapted bracket 134 is fitted on the boss portion 128. Thus, deformations between the strainer-mounting boss portion 126, which is provided at the portion where the journal section 78 and the bearing beam 104 are connected together for fixing the oil strainer 130 thereat, and the bracket-mounting boss portion 128 caused by engine operation can be reduced, when compared with conventional practice in which the boss portion 126 or 128 is positioned either at an intermediate portion of the journal section 78, which portion experiences a large degree of deformations when the engine 2 is run, or at a portion of the bearing beam 104 where the journal section 78 is not connected to the bearing beam 104. As a result, the strength of the oil strainer 130 as well as that of the strainer-adapted bracket 134 can be decreased, thereby realizing the light weight and low cost crank chamber structure.

As previously described, in the crank chamber structure pursuant to the present invention, the substantially egg-like cross-sectional shape approaching a spherical surface makes it possible to provide improved rigidity of the crank chamber as well as a smaller surface area of the crank chamber. In addition, the aforesaid cross-sectional shape makes it possible to provide a smooth flow of rotational wind caused by respective revolutions of the crankshaft and the connecting rods, and further to reduce the cubic volume of gases in the crank chamber.

As a result, in the crank chamber structure, such improved rigidity can reduce vibratory noise caused by running of the engine, and such a reduced surface area can realize a light-weight crank chamber structure at low cost. In addition, air resistance, which is caused by stirred gases associated with respective rotations of the crankshaft and the connecting rods, can be lessened to reduce a loss of output from the engine because the rotational wind caused by respective revolutions of the crankshaft and the connecting rods can be made smoother, and further because the cubic volume inside the crank chamber can be made smaller.

In addition, in the crank chamber structure, the opposed case-side skirt sections are collapsed inwardly so as to taper toward the oil pan-mating surface, whereby the lower case is provided with openings which communicate with the oil pan. As a result, a spray of oil which is blown from both the crankshaft and the connecting rods can be drawn directly into the oil pan in reduced amounts, with a consequential reduction in aeration and oil mist, both of which occur in the oil pan.

Consequently, in the crank chamber structure, the aeration in the oil drawn from the oil strainer and then fed to each section of the engine by means of the oil pump can be reduced in amount, resulting in enhanced lubricating performance of the engine. In addition, the oil mist, which is moved together with blow-by gas into the breather chamber inside the head cover, can be reduced in amount, and thus the breather chamber can be made smaller in cubic volume. As a result, the engine can be reduced in height, and can be made lighter in weight and lower in cost, with a consequential improvement in convenience as to mounting the engine into an engine compartment of a vehicle.

Accordingly, in the crank chamber structure it is possible to provide the case-side bearing beams whose rigidity is high enough to reinforce the case-side journal sections with the aid of the case-side skirt sections of the lower case. The curved formation of the case-side bearing beams makes it possible to provide the crank chamber structure closest in shape to peripheral loci "L" of the connecting rods. In addition, the case-side bearing beams are curved to stay closer to the case-side journal sections, whereby the supporting rigidity of the journal sections in the axis direction of the crankshaft can be enhanced. As a result, when the engine is run, the crank chamber structure is capable of restraining deformation of the case-side journal sections in the axis direction of the crankshaft, with an ensuing reduction in vibratory noise.

In the crank chamber structure, the case-side skirt sections and the case-side outer skirt sections allow the lower case to be formed with a substantially inverted "y"-like cross-sectional shape on opposite sides thereof. As a result, the bending rigidity of the lower case in longitudinal and transverse directions thereof can be increased, and deformation of the oil pan-mating surfaces can be minimized or prevented when the engine is run. In addition, the lower case can be made lighter in weight.

Consequently, it is possible to reduce noises from the lower case, the oil pan, and the baffle plate because of the improved rigidity of the lower case as well as such controlled deformation of the oil pan-mating surfaces. In addition, the baffle plate can be disposed on the oil pan at fewer spots where the baffle plate is secured thereto. The baffle plate can be made smaller in thickness. As a result, the light-weighted baffle plate having fewer fixing spots thereon is achievable. In addition, the lower case can be made lower in cost as well as being made lighter in weight.

In the crank chamber structure, the lower case has the case-side blow-by gas passage and the case-side oil drop passage provided between the pair of ribs, and respective inlet and outlet of the aforesaid case-side passages are positioned offset outwardly by means of the protrusions which include slanted surfaces. Moreover, the preceding inlet and outlet are made smaller in cross-sectional area than the respective case-side passages by means of the protrusions. As a result, the crank chamber structure can be configured in such a manner that the oil mist, which occurs in the crank chamber having the substantially egg-like cross-sectional shape, cannot be moved to the aforesaid inlet of the case-side blow-by gas passage without flowing below the case-side bearing beams.

Accordingly, the crank chamber structure increases the distance that the oil mist is moved from the inside of the crank chamber to the inlet of the case-side blow-by gas passage. This greater distance allows a reduced amount of the oil mist to be moved to the breather chamber. The breather chamber can be made smaller in cubic volume. The engine can be made smaller in height, and further can be made lighter in weight and lower in cost.

In the crank chamber structure, since the aforesaid inlet and outlet of the respective case-side passages are positioned offset outwardly, then the inlet and outlet are thereby spaced apart from the axis of the crankshaft, and oil falling into the oil pan from the outlet of the case-side oil drop passage can be isolated from the suction opening of the oil strainer. In addition, the inlet of the case-side blow-by gas passage can be remote from the area of the revolving crankshaft where the oil mist is present in large quantities.

As a result, the crank chamber structure allows the oil strainer to be resistant to draw in the aeration caused by such falling oil because the oil dropping into the oil pan can be isolated from the suction opening of the oil strainer. In addition, the aeration in the supplied oil can be reduced in amount, with consequential enhancement in the lubricating performance of the engine. Further, since the inlet of the case-side blow-by gas passage can be remote from the area of the crankshaft where the oil mist is present in large quantities, then the oil mist moved into the breather chamber can be reduced in amount, and thus the breather chamber can be made smaller in cubic volume. As a result, the engine can be reduced in height, and can be made lighter in weight and lower in cost.

Moreover, since the aforesaid passage inlet and outlet are made smaller in cross-sectional area than the respective case-side passages, the crank chamber structure allows acceleration of the velocities of gases due to the smaller cross-sectional area of the inlet, and thereafter delays the gases due to the larger cross-sectional area of the case-side blow-by gas passage. Similarly to the breather chamber inside the head cover, the crank chamber structure is allowed to function as a separator.

Consequently, the case-side blow-by gas passage and the passage inlet permit the crank chamber structure to function as the breather chamber. As a result, the oil mist blown into the breather chamber can be reduced in amount, and thus the breather chamber can be made smaller in cubic volume. Then, the engine can be reduced in height, and can be made lighter in weight and lower in cost.

In the crank chamber structure, the case-side blow-by gas passage of the lower case, the block-side blow-by gas passage of the cylinder block, and the head-side blow-by gas passage of the cylinder head are arranged so as to be in substantially linear communication with each other. As a result, blow-by gas moves smoothly into the breather chamber in the head cover without being lodged substantially midway along the above passages.

Thus, the crank chamber structure permits the blow-by gas to be supplied to the intake system of the engine without allowing the blow-by gas to reside in the crank chamber. As a result, the gases in the crank chamber are reduced in pressure, and then air resistance, which is caused by stirred gases incurred with respective rotations of the crankshaft and the connecting rods, can be lessened, with a concomitant reduction in output loss of the engine.

In the crank chamber structure, the baffle plate is provided for covering the openings of the lower case, and further for forming the crank chamber in cooperation with the block-side skirt sections and the case-side skirt sections. The crank chamber has a substantially egg-like cross-sectional shape. The baffle plate is mounted on the case-side bearing beams. As a result, the baffle plate need not be provided with a strainer-adapted hole punched therethrough. Thus, the baffle plate can be made smaller in dimension, when compared with a baffle plate which mounts on the oil pan. In addition, the baffle plate can be formed with a smooth curvilinear surface shape which continuously extends from and defines the bottom of the substantially egg-like cross-sectional shape of the crank chamber. As a result, an inner cubic volume of the crank chamber can be reduced.

Then, the crank chamber structure can be made smaller in dimension, lighter in weight, and lower in cost because the baffle plate is not disposed on the oil pan. Further, in the crank chamber structure, the oil falling into the oil pan can be isolated from the suction opening of the oil strainer because the strainer-adapted hole is not provided. Consequently, the oil strainer can be rendered immune to admit the aeration caused by the falling oil. In addition, the aeration in the supplied oil can be reduced in amount, and the engine can be provided with improved lubricating performance.

Further, since the baffle plate can be made compact, then the crank chamber structure can be made smaller in dimension, lighter in weight, and lower in cost. Further, since the baffle plate can be formed with a smooth curvilinear surface shape which continuously extends in a substantially egg-like cross-sectional shape, then the rotational wind caused by respective revolutions of the crankshaft and the connecting rods can be rendered smoother. In addition, the cubic volume inside the crank chamber can be made smaller. As a result, it is possible to lessen the air resistance which is caused by stirred gases produced by respective rotations of the crankshaft and the connecting rods. The engine thereby experiences a reduced output loss.

Further, in the crank chamber structure, since the baffle plate can be formed with the smooth curvilinear surface shape which continuously extends in the substantially egg-like cross-sectional shape, then the baffle plate can be provided with improved rigidity, with the result that noise from the running engine can be reduced.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a crank chamber structure for an engine having a cylinder head disposed above a cylinder block, a head cover disposed on said cylinder head, a lower case positioned below said cylinder block for rotatably supporting a crankshaft, an oil pan provided below said lower case, a baffle plate provided in said oil pan, and a crank chamber defined between said cylinder block and said lower case, the improvement comprising: opposed block-side skirt sections and opposed case-side skirt sections respectively provided on said cylinder block and said lower case, both of said skirt sections being curved outwardly to permit said crank chamber to enclose peripheral loci of connecting rods and to permit said crank chamber to be formed by a curvilinear surface whose radius is smaller at successively higher positions but is greater at successively lower positions, thereby providing a substantially egg-like cross-sectional shape; and an opening communicating to said oil pan, said opening being provided in said lower case by said opposed case-side skirt sections being collapsed inwardly to taper toward an oil pan-mating surface of said lower case.

2. A crank chamber structure for an engine as defined in claim 1, wherein a case-side bearing beam is provided in said lower case for connecting a case-side journal section with said oil pan-mating surface of said case-side skirt section, said journal section rotatably supporting said crankshaft, and wherein said case-side bearing beam is curved such that a portion of said bearing beam connecting with said case-side journal section is inwardly located, while a portion of said bearing beam between said case-side journal sections is curved outwardly.

3. A crank chamber structure for an engine as defined in claim 1, wherein said lower case has an outer skirt section positioned outside said case-side skirt section for connecting a substantially midway portion of said case-side skirt section with an oil pan-mating section.

4. A crank chamber structure for an engine as defined in claim 2, wherein said lower case is provided with a pair of ribs whose one ends are linked to respective portions where said case-side journal sections and said case-side bearing beams are connected together, while the other ends of said pair of ribs extend in an outwardly spreading manner, and are further connected respectively to block-mating sections and oil pan-mating sections, and wherein a case-side blow-by gas passage and a case-side oil drop passage are provided between said pair of ribs, said case-side blow-by gas passage and said case-side oil drop passage having a passage inlet and a passage outlet respectively provided at said oil pan-mating surface, and respective protrusions being provided in said inlet and outlet, each of said protrusions including a slanted surface which projects outwardly and which is inclined inwardly from said oil pan-mating surface toward a block-mating surface, whereby said passage inlet and outlet are positioned offset outwardly and are smaller in cross-sectional area than both of said case-side blow-by gas passage and said case-side oil drop passage.

5. A crank chamber structure for an engine as defined in claim 4, wherein said cylinder block is provided with a block-side blow-by gas passage whose one end is communicated to said case-side blow-by gas passage of said lower case, said cylinder head being provided with a head-side blow-by gas passage whose one end is communicated to said block-side blow-by gas passage, while the other end of said head-side blow-by gas passage is communicated to a breather chamber inside said head cover, and wherein said case-side blow-by gas passage, said block-side blow-by gas passage, and said head-side blow-by gas passage are arranged in said lower case, said cylinder block, and said cylinder head, respectively, so as to be in linear communication with each other.

6. A crank chamber structure for an engine as defined in claim 1, wherein a baffle plate is provided on said lower case for covering said opening of said lower case, and further for forming said crank chamber in cooperation with both of said block-side skirt sections and said case-side skirt sections, said crank chamber having the substantially egg-like cross-sectional shape, said baffle plate being mounted on a case-side bearing beam.

* * * * *